US009901135B2

(12) United States Patent
Cross

(10) Patent No.: US 9,901,135 B2
(45) **Date of Patent: *Feb. 27, 2018**

(54) FOOTWEAR WITH FLEXIBLE AUXETIC GROUND ENGAGING MEMBERS

(71) Applicant: NIKE, Inc., Beaverton, OR (US)

(72) Inventor: Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 73 days.

This patent is subject to a terminal disclaimer.

(21) Appl. No.: 14/564,694

(22) Filed: Dec. 9, 2014

(65) Prior Publication Data

US 2016/0157553 A1 Jun. 9, 2016

(51) Int. Cl.

| | |
|---|---|
| ***A43B 13/22*** | (2006.01) |
| ***A43B 11/00*** | (2006.01) |
| ***A43B 13/02*** | (2006.01) |
| ***A43B 13/12*** | (2006.01) |
| ***A43B 13/14*** | (2006.01) |
| ***A43B 13/18*** | (2006.01) |

(52) U.S. Cl.

CPC ..... *A43B 13/023* (2013.01); *A43B 13/122* (2013.01); *A43B 13/14* (2013.01); *A43B 13/181* (2013.01); *A43B 13/184* (2013.01); *A43B 13/187* (2013.01); *A43B 13/223* (2013.01)

(58) Field of Classification Search

CPC ..... A43B 13/23; A43B 13/122; A43B 13/14; A43B 13/181; A43B 13/184; A43B 13/187; A43B 13/223

USPC ..... 36/30 R, 31, 103, 102, 134, 59 C

See application file for complete search history.

(56) References Cited

U.S. PATENT DOCUMENTS

| | | | | |
|---|---|---|---|---|
| 503,062 A | | 8/1893 | Norwood | |
| 2,580,840 A | * | 1/1952 | Rogndal | A43B 13/223 36/29 |
| 2,627,676 A | * | 2/1953 | Hack | A43B 13/184 36/29 |
| 2,963,722 A | | 12/1960 | Stix | |
| 3,626,532 A | | 12/1971 | Frank | |

(Continued)

FOREIGN PATENT DOCUMENTS

| | | |
|---|---|---|
| EP | 0207063 | 12/1986 |
| GB | 2455167 A | 6/2009 |

(Continued)

OTHER PUBLICATIONS

International Search Report and Written Opinion dated Apr. 1, 2016 in PCT Application No. PCT/2015/055635.

(Continued)

*Primary Examiner* — Jila M Mohandesi

(74) *Attorney, Agent, or Firm* — Quinn IP Law

(57) ABSTRACT

An article of footwear may include an outer member that has a first ground engaging member extending downward from the outer surface of an outer member. Ground engaging members, or cleats, may be auxetic structures that can increase their dimensions in a direction that is orthogonal to the direction of applied force or tension. Ground engaging member shapes may include various polygonal features. The first ground engaging member may have a three-pointed star-shaped pyramidal structure. The outer member may have an inner surface with apertures that correspond with the ground engaging members of the outer surface.

8 Claims, 17 Drawing Sheets

(56) References Cited

U.S. PATENT DOCUMENTS

| | | | | |
|---|---|---|---|---|
| 3,745,600 | A | 7/1973 | Rubico et al. | |
| 3,757,436 | A | 9/1973 | Winkler et al. | |
| 4,340,626 | A | 7/1982 | Rudy | |
| 4,375,728 | A * | 3/1983 | Dassler | A43B 13/223 36/114 |
| 4,535,553 | A | 8/1985 | Derderian | |
| 4,668,557 | A * | 5/1987 | Lakes | B29C 44/357 264/321 |
| 4,753,021 | A | 6/1988 | Cohen | |
| 4,756,098 | A | 7/1988 | Boggia | |
| 4,999,931 | A | 3/1991 | Vermeulen | |
| 5,197,206 | A | 3/1993 | Shorten | |
| 5,337,492 | A | 8/1994 | Anderie | |
| 5,918,338 | A | 7/1999 | Wong | |
| 6,151,804 | A | 11/2000 | Hieblinger | |
| 6,276,073 | B1 | 8/2001 | Curley, Jr. | |
| 6,412,593 | B1 | 7/2002 | Jones | |
| 6,826,852 | B2 * | 12/2004 | Fusco | A43B 13/12 36/103 |
| 6,862,820 | B2 | 3/2005 | Farys et al. | |
| 6,959,505 | B2 * | 11/2005 | Poe | A43B 1/0009 36/141 |
| 7,089,690 | B2 | 8/2006 | Krstic | |
| 7,132,032 | B2 | 11/2006 | Tawney et al. | |
| 7,146,752 | B2 * | 12/2006 | Pasternak | A43B 13/223 36/59 C |
| 7,160,621 | B2 | 1/2007 | Chaudhari et al. | |
| D541,017 | S * | 4/2007 | McClaskie | D2/951 |
| 7,254,906 | B2 | 8/2007 | Morris et al. | |
| 7,287,343 | B2 | 10/2007 | Healy | |
| 7,546,698 | B2 | 6/2009 | Meschter | |
| 7,574,818 | B2 | 8/2009 | Meschter | |
| 7,596,889 | B2 * | 10/2009 | Pasternak | A43B 13/223 36/59 C |
| D612,610 | S | 3/2010 | Gonzalez | |
| 7,770,307 | B2 | 8/2010 | Meschter | |
| 7,814,852 | B2 | 10/2010 | Meschter et al. | |
| 7,870,681 | B2 | 1/2011 | Meschter | |
| 7,870,682 | B2 | 1/2011 | Meschter et al. | |
| D643,196 | S * | 8/2011 | Young | D2/951 |
| 8,002,879 | B2 | 8/2011 | Hook | |
| 8,074,418 | B2 | 12/2011 | Thiagarajan | |
| 8,084,117 | B2 * | 12/2011 | Lalvani | B32B 3/266 428/135 |
| 8,122,616 | B2 | 2/2012 | Meschter et al. | |
| 8,132,340 | B2 | 3/2012 | Meschter | |
| 8,225,530 | B2 | 7/2012 | Sokolowski et al. | |
| 8,266,827 | B2 | 9/2012 | Dojan et al. | |
| 8,277,719 | B2 | 10/2012 | Alderson et al. | |
| 8,312,645 | B2 | 11/2012 | Dojan et al. | |
| 8,375,604 | B2 | 2/2013 | Eder | |
| 8,388,791 | B2 | 3/2013 | Dojan et al. | |
| 8,490,299 | B2 | 7/2013 | Dua et al. | |
| 8,544,197 | B2 | 10/2013 | Spanks et al. | |
| 8,631,589 | B2 | 1/2014 | Dojan | |
| 8,652,602 | B1 | 2/2014 | Dolla | |
| D716,027 | S | 10/2014 | Kirschner | |
| 2004/0111922 | A1 | 6/2004 | Fusco | |
| 2004/0181972 | A1 | 9/2004 | Csorba | |
| 2005/0252037 | A1 | 11/2005 | Hofmann | |
| 2005/0252038 | A1 | 11/2005 | Braunschweiler | |
| 2008/0011021 | A1 | 1/2008 | Starbuck et al. | |
| 2008/0209766 | A1 | 9/2008 | Braunschweiler | |
| 2009/0064536 | A1 | 3/2009 | Klassen et al. | |
| 2009/0064540 | A1 | 3/2009 | Sokolowski | |
| 2009/0119820 | A1 | 5/2009 | Bentham et al. | |
| 2009/0241369 | A1 | 10/2009 | Votolato | |
| 2009/0307932 | A1 | 12/2009 | Kirby et al. | |
| 2010/0095551 | A1 | 4/2010 | Gupta et al. | |
| 2011/0119956 | A1 | 5/2011 | Borel et al. | |
| 2011/0168313 | A1 | 7/2011 | Ma et al. | |
| 2011/0247237 | A1 * | 10/2011 | Jara | A43B 3/0036 36/103 |
| 2012/0021167 | A1 | 1/2012 | Plant | |
| 2012/0023686 | A1 | 2/2012 | Huffa et al. | |
| 2012/0129416 | A1 | 5/2012 | Anand et al. | |
| 2012/0159810 | A1 | 6/2012 | Klassen | |
| 2012/0180341 | A1 | 7/2012 | Crowley, II | |
| 2012/0181896 | A1 | 7/2012 | Kornbluh et al. | |
| 2012/0233878 | A1 | 9/2012 | Hazenberg et al. | |
| 2012/0315456 | A1 | 12/2012 | Scarpa et al. | |
| 2013/0071583 | A1 | 3/2013 | Evans et al. | |
| 2013/0081305 | A1 | 4/2013 | Byrne | |
| 2013/0160324 | A1 | 6/2013 | Peyton et al. | |
| 2013/0328440 | A1 | 12/2013 | Kornbluh et al. | |
| 2014/0053311 | A1 | 2/2014 | Nordstrom et al. | |
| 2014/0059734 | A1 * | 3/2014 | Toronjo | A41D 31/005 2/69 |
| 2014/0101816 | A1 | 4/2014 | Toronjo | |
| 2014/0109286 | A1 | 4/2014 | Blakely | |
| 2014/0165427 | A1 | 6/2014 | Molyneux et al. | |
| 2014/0173938 | A1 | 6/2014 | Beye et al. | |
| 2014/0237850 | A1 | 8/2014 | Hull | |
| 2015/0075033 | A1 | 3/2015 | Cross | |
| 2015/0075034 | A1 | 3/2015 | Cross | |
| 2015/0245683 | A1 | 9/2015 | Cross | |
| 2015/0245685 | A1 | 9/2015 | Cross | |
| 2016/0157558 | A1 | 6/2016 | Cross | |

FOREIGN PATENT DOCUMENTS

| | | | | |
|---|---|---|---|---|
| GB | 2463446 | A | 3/2010 | |
| WO | 03022085 | A2 | 3/2003 | |
| WO | 2004052136 | | 6/2004 | |
| WO | 2007052054 | A1 | 5/2007 | |
| WO | WO 2009118055 | A1 * | 10/2009 | A43B 13/184 |
| WO | 2012171911 | A1 | 12/2012 | |
| WO | 2014018500 | | 1/2014 | |
| WO | 2015041796 | | 3/2015 | |

OTHER PUBLICATIONS

International Search Report and Written Opinion dated Jan. 29, 2016 in PCT Application No. PCT/US2015/055642.

Partial Search Report dated Jan. 22, 2016 in PCT Application No. PCT/US2015/055635.

International Search Report and Written Opinion dated Jan. 28, 2016 in PCT Application No. PCT/US2015/055652.

International Search Report and Written Opinion for Application No. PCT/US2014/052038, dated Dec. 4, 2014.

Office Action dated Jun. 15, 2016 for U.S. Appl. No. 14/565,143.

Office Action dated Aug. 29, 2016 for U.S. Appl. No. 14/564,797.

* cited by examiner

FOOTWEAR WITH FLEXIBLE AUXETIC GROUND ENGAGING MEMBERS

CROSS-REFERENCE TO RELATED APPLICATIONS

This application is related to co-pending U.S. patent application Ser. No. 14/565,143, filed Dec. 9, 2014, titled "Footwear with Auxetic Ground Engaging Members," the entirety of which is herein incorporated by reference. This application is also related to co-pending U.S. patent application Ser. No. 14/564,797, filed Dec. 9, 2014, titled "Footwear With Flexible Auxetic Sole Structure," the entirety of which is herein incorporated by reference.

BACKGROUND

The present embodiments relate generally to a sole structure for an article of footwear and, more particularly, to an article of footwear with ground engaging members. It is advantageous, when participating in various activities, to have footwear that provides traction and stability on the surface upon which the activities take place. Accordingly, sole structures for articles of footwear have been developed with traction systems that include ground engaging members to provide traction on a variety of surfaces. Examples include cleated shoes developed for outdoor sports, such as soccer, football, and baseball. In some cases, the shape and orientation of ground engaging members on a sole structure may be configured particularly for forward and rearward traction.

SUMMARY

In one aspect, the present disclosure is directed to a sole structure for an article of footwear, the sole structure comprising an outer member with a base portion, and a ground engaging member extending away from the base portion. The ground engaging member has a plurality of faces extending from the base portion on an outer side of the outer member, and each of the plurality of faces are joined at an apex of the ground engaging member. The ground engaging member also has a hollow interior region that is bounded by the plurality of faces on the outer side, and the hollow interior region is open on an inner side of the outer member. The base portion has a first thickness and the apex portion of the ground engaging member has a second thickness, and the first thickness is substantially different than the second thickness.

In another aspect, the present disclosure is directed to a sole structure for an article of footwear, the sole structure comprising an outer member with a base portion and a ground engaging member extending away from the base portion. The ground engaging member has a plurality of faces extending from a base portion, and each of the plurality of faces are joined at an apex of the ground engaging member. The apex has an outer apex surface disposed on an outer surface of the outer member and the apex has an inner apex surface disposed on an inner surface of the outer member. The outer apex surface is associated with a first curvature and the inner apex surface is associated with a second curvature. In addition, the first curvature is substantially greater than the second curvature.

In another aspect, the present disclosure is directed to a sole structure for an article of footwear, the sole structure comprising an outer member and a plurality of ground engaging members extending away from a base portion of the outer member. The plurality of ground engaging members include a ground engaging member. The ground engaging member has at least a first arm portion, and the first arm portion has a first face and a second face. The first face and the second face are joined along a first hinge portion. In addition, the first face is attached to the outer member along a second hinge portion, and the second face attached to the outer member along a third hinge portion. A free end of the ground engaging member is an apex, and the apex is rounded. An end of the first face is associated with the apex, and an end of the second face is associated with the apex. The first face includes a first intermediate portion extending between the apex and the base portion and the second face includes a second intermediate portion extending between the apex and the base portion. The apex is thicker than the first intermediate portion and the apex is also thicker than the second intermediate portion. The ground engaging member has a first configuration and a second configuration, where the apex has a first height with respect to the base portion in the first configuration, and the apex has a second height with respect to the base portion in the second configuration. The first hinge portion, the second hinge portion, and the third hinge portion facilitate the transition of the ground engaging member between the first configuration and the second configuration. The plurality of ground engaging members are arranged on the outer member to provide the sole structure with the auxetic structure.

Other systems, methods, features and advantages of the embodiment will be, or will become, apparent to one of ordinary skill in the art upon examination of the following figures and detailed description. It is intended that all such additional systems, methods, features and advantages be included within this description and this summary, be within the scope of the embodiment, and be protected by the following claims.

BRIEF DESCRIPTION OF THE DRAWINGS

The embodiment can be better understood with reference to the following drawings and description. The drawings are schematic and, therefore, the components in the figures are not necessarily to scale, emphasis instead being placed upon illustrating the principles of the embodiment. Moreover, in the figures, like reference numerals designate corresponding parts throughout the different views.

DETAILED DESCRIPTION

Figure 1:
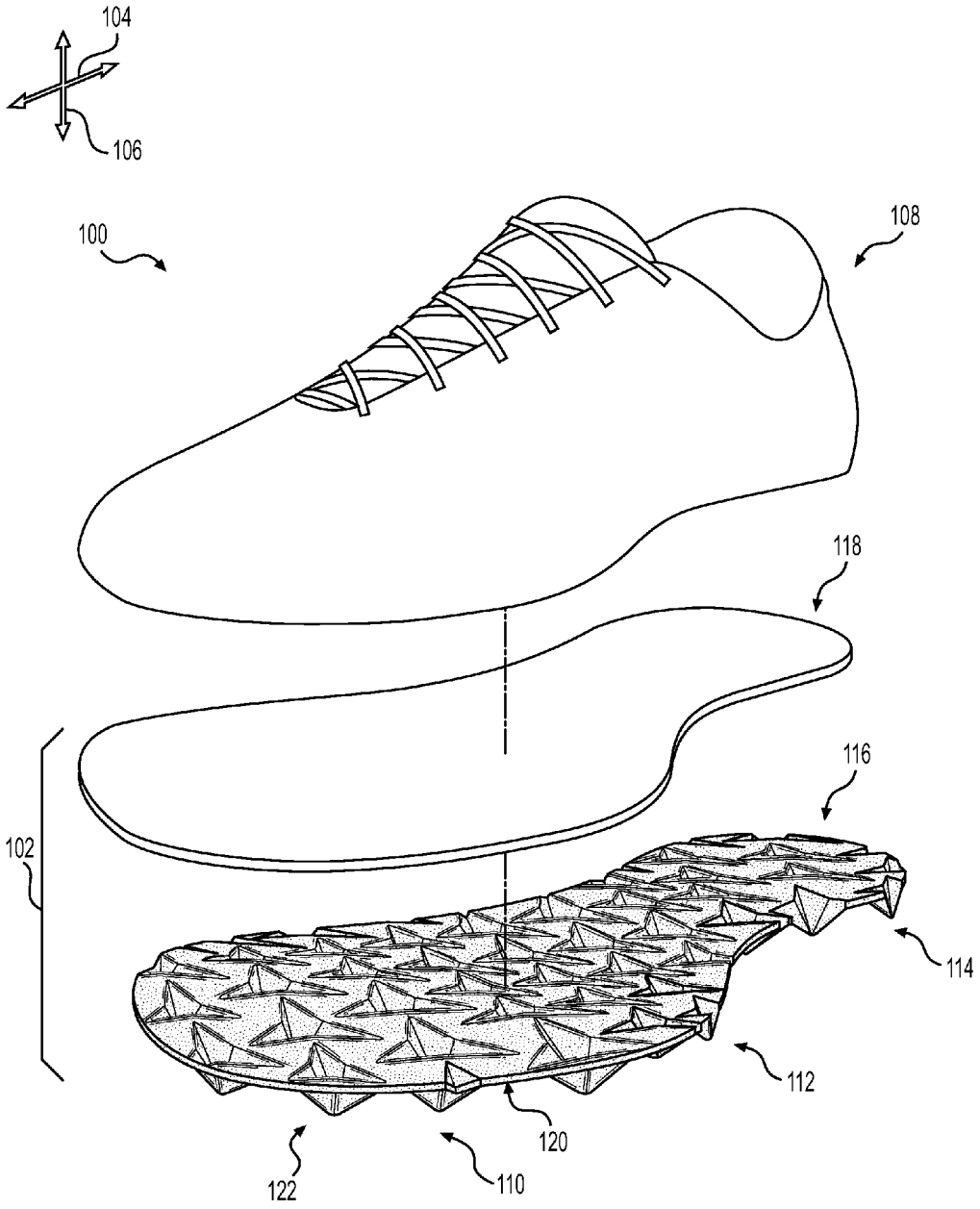
FIG. 1 is an exploded isometric view of an embodiment of an article of footwear having an outer member with ground engaging members.

The following discussion and accompanying figures disclose a sole structure for an article of footwear. Concepts associated with the footwear disclosed herein may be applied to a variety of athletic footwear types, including soccer shoes, baseball shoes, football shoes, and golf shoes, for example. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot portion to a heel portion of the sole. The term "longitudinal axis," as used throughout this detailed description and in the claims, refers to an axis oriented in a longitudinal direction.

The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot. The term "lateral axis," as used throughout this detailed description and in the claims, refers to an axis oriented in a lateral direction.

The term "horizontal," as used throughout this detailed description and in the claims, refers to any direction substantially parallel with the longitudinal direction, the lateral direction, and all directions in between. In cases where an article is planted on the ground, a horizontal direction may be parallel with the ground. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions, along a vertical axis. For example, in cases where a sole is planted flat on a ground surface, the vertical direction may extend from the ground surface upward. It will be understood that each of these directional adjectives may be applied to individual components of a sole. Furthermore, the term "outer surface," or "outer side" as used throughout this detailed description and in the claims, refers to the surface of a component that would be facing away from the foot when worn by a wearer. "Inner surface," or "inner side" as used throughout this detailed description and in the claims, refers to the surface of a component that is facing inward, or the surface that faces toward the foot when worn by a wearer.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "permanently attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be permanently attached by virtue of being integrally formed, for example, in a molding process.

FIG. 1 depicts an exploded view of an embodiment of an article of footwear ("article") 100, which may include a sole structure 102 and an upper 108 configured to receive a foot. Sole structure 102 may be permanently attached to a bottom portion of upper 108. As shown in FIG. 1 for reference purposes, article 100 may be divided into three general regions, including a forefoot region 110, a midfoot region 112, and a heel region 114. Forefoot region 110 generally includes portions of article 100 corresponding with the toes and the joints connecting the metatarsals with the phalanges. Midfoot region 112 generally includes portions of article 100 corresponding with an arch area of the foot. Heel region 114 generally corresponds with rear portions of the foot, including the calcaneus bone. Forefoot region 110, midfoot region 112, and heel region 114 are not intended to demarcate precise areas of article 100. Rather, forefoot region 110, midfoot region 112, and heel region 114 are intended to represent general relative areas of article 100 to aid in the following discussion.

The accompanying figures depict various embodiments of article 100, having sole structures 102 suited for multidirectional traction on natural and/or synthetic turf. Article 100, as depicted, may be suited for a variety of activities on natural and/or synthetic turf, such as agility/speed training and competition, as well as other sports, such as baseball, soccer, American football, and other such activities where traction and grip may be significantly enhanced by cleat members. In addition, various features of the disclosed sole structures 102 (and/or variations of such features) may be implemented in a variety of other types of footwear.

As sole structure 102 and upper 108 both span substantially the entire length of article 100 along a longitudinal direction 104, the terms forefoot region 110, midfoot region 112, and heel region 114 apply not only to article 100 in general, but also to sole structure 102 and upper 108, as well as the individual elements of sole structure 102 and upper 108.

In different embodiments, upper 108 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. Upper 108 may alternatively implement any of a variety of other configurations, materials, and/or closure mechanisms.

In different embodiments, sole structure 102 may have a configuration that extends between a bottom surface of upper 108 and the ground in a vertical direction 106 and may be secured to upper 108 in any suitable manner. For example, sole structure 102 may be secured to upper 108 by adhesive attachment, stitching, welding, or any other suitable method. Sole structure 102 may include provisions for attenuating ground reaction forces (that is, cushioning and stabilizing the foot during vertical and horizontal loading) in some embodiments. In addition, sole structure 102 may be configured to provide traction, impart stability, and/or limit various foot motions, such as pronation, supination, and/or other motions.

In different embodiments, the configuration of sole structure 102 may vary significantly according to one or more types of ground surfaces on which sole structure 102 may be used. For example, the disclosed concepts may be applicable to footwear configured for use on indoor surfaces and/or outdoor surfaces. The configuration of sole structure 102 may vary based on the properties and conditions of the surfaces on which article 100 is anticipated to be used. For example, sole structure 102 may vary depending on whether the surface is harder or softer. In addition, sole structure 102 may be tailored for use in wet or dry conditions.

Sole structure 102 may include multiple components in some embodiments, which may individually and/or collectively provide article 100 with a number of attributes, such as support, rigidity, flexibility, stability, cushioning, comfort, reduced weight, traction, and/or other attributes. For example, in some embodiments, sole structure 102 may incorporate incompressible plates, moderators, and/or other elements that attenuate forces, influence the motions of the foot, and/or impart stability, for example. Further, while various types of cleated article 100 may be provided without a midsole, in some embodiments, sole structure 102 may also include a midsole 118 or another sole layer disposed between an outer member 116 and upper 108. In some embodiments, an additional sole layer disposed between outer member 116 and upper 108 may include cushioning members, reinforcing structures, support structures, or other features. In another embodiment, midsole 118 may include a recess to hold outer member 116. In other embodiments, midsole 118 may not be included in sole structure 102 and/or outer member 116 may be joined directly to upper 108.

Article of footwear 100 according to the present disclosure may include a sole structure 102 with outer member 116. In different embodiments, outer member 116 may include features that provide traction and stability on any of a variety of surfaces, and in any of a variety of conditions. In some embodiments, outer member 116 may include a base portion 120 along its outer side 299 that is joined to one or more ground engaging members 122. In some embodiments, ground engaging members 122 extend away from base portion 120 of outer member 116. In one embodiment, ground engaging members 122 may be permanently attached to the base portion 120 of outer member 116. In other embodiments, ground engaging member 122 may be attached in non-permanent manner. In some embodiments, ground engaging members 122 may be cleats or structures substantially similar to cleats. In other embodiments, ground engaging members 122 may be convex portions, or convex members. Some embodiments of such structures are discussed in greater detail below.

In different embodiments, outer member 116 may include a substantially flat or plate-like element that supports the foot, and serves as a platform from which ground engaging members 122 may extend. In some embodiments, outer member 116, although relatively flat, may include various anatomical contours, such as a relatively rounded longitudinal profile, a heel portion that is higher than the forefoot portion, a higher arch support region, and other anatomical features.

Embodiments of ground engaging members 122 may have one or more features that provide increased traction, directional traction, ground penetration, and/or ground extraction. Such features may include, for example, shapes, sizes, positioning on the outer member, as well as the orientation of ground engaging members 122.

Figure 2:
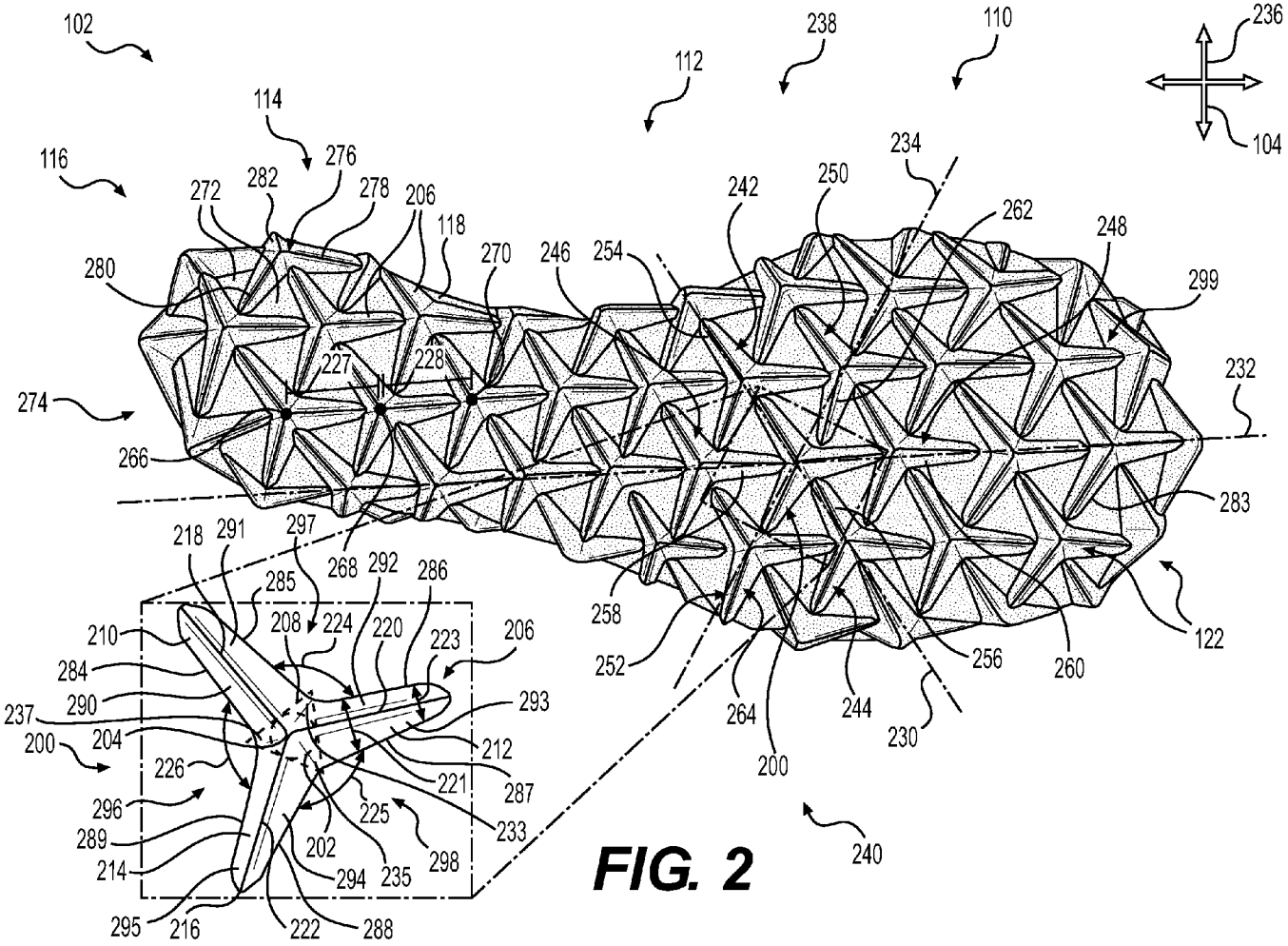
FIG. 2 is an illustration of the outer surface of an embodiment of an outer member for an article of footwear.

FIG. 2 is a view of the bottom surface of an embodiment of sole structure 102. FIG. 2 depicts the outer surface of sole structure 102, comprising outer member 116, and ground engaging members 122. An enlarged view of a first ground engaging member 200 is included for purposes of illustration.

In the embodiment shown in FIG. 2, ground engaging members 122 and other portions of outer member 116 may be configured in a geometric pattern that provides an auxetic structure to at least some portions of sole structure 102. As will be described in greater detail below with respect to FIGS. 3-12, sole structure 102 may include an auxetic structure that, when placed under tension in a first direction, can increase in size both in the first direction and in the direction in the plane of the structure that is orthogonal to the first direction. In some embodiments, outer member 116 may be at least partially an auxetic structure. A structure that deforms due to its auxetic properties may be said to undergo an auxetic action.

As used herein, the terms "auxetic" generally refers to materials that have a negative Poisson's ratio, such that when they are under tension in a first direction, their dimensions increase both in the first direction and in a direction orthogonal the first direction. Articles of footwear having soles with an auxetic structure are described in Cross, U.S. patent application Ser. No. 14/030,002, filed Sep. 18, 2013 and titled "Auxetic Structures and Footwear with Soles Having Auxetic Structures", which is incorporated by reference above. In some cases, the term "reactive structure" may also be used to describe an auxetic structure. For example, if the structure can be described as having a length, a width and a thickness, then when the structure is under tension longitudinally, the structure increases in width. In some embodiments, the auxetic structures are bi-directionally auxetic such that they increase in length and width when stretched longitudinally and in width and length when stretched laterally, but do not increase in thickness. Also, although such auxetic structures will generally have at least a monotonic relationship between the applied tension and the increase in the dimension orthogonal to the direction of the tension, that relationship need not be proportional or linear, and in general need only increase in response to increased tension. Thus, in one embodiment, outer member 116 can expand in a first direction and a second direction when outer member 116 is tensioned in the first direction, where the second direction is substantially perpendicular to the first direction.

In different embodiments, ground engaging members 122 may be used to form auxetic structures in sole structure 102. In some embodiments, ground engaging members 122 may comprise portions that can project outwardly from the base of a sole structure. In different embodiments, portions may be any shape, size, or geometry. For example, in some embodiments, sole structure 102 or portions of soles structure 102 may incorporate any of the structures disclosed in Nordstrom, U.S. Patent Publication Number 2014/0053311, published Feb. 27, 2014 (now U.S. patent application Ser. No. 14/011,201, filed Aug. 27, 2013) and titled "Dynamic Materials Integrated Into Articles for Adjustable Physical Dimensional Characteristics," which is incorporated by reference in its entirety herein. In some embodiments, various polygonal features or portions may be used to form the auxetic structures, such as triangular, quadrilateral, pentagonal, hexagonal, heptagonal or octagonal features. In other embodiments, portions may be polygonal features used to form three-pointed star-shaped projections, four-pointed star-shaped projections, five-pointed star-shaped projections, or six-pointed star-shaped projections. In the embodiment of FIG. 2, the portions are depicted as ground engaging members 122 that include generally triangular features forming three-pointed star-shaped pyramidal structures or projections. In one embodiment, ground engaging members may have the approximate geometry of a pyramid with a tri-star base.

Thus, in different embodiments, ground engaging members 122 may be configured in varying geometric patterns. In some embodiments, ground engaging members 122 may include convex features. In other embodiments, ground engaging members 122 may include various hinges or predetermined regions of bending. In one embodiment, when ground engaging members 122 are vertically compressed they can unfold and extend in a horizontal direction. In some embodiments, there may be multiple ground engaging members 122 arranged on sole structure 102, and in one embodiment, ground engaging members 122 may function together to provide auxetic structure to sole structure 102. For example, in one embodiment, as shown with respect to first ground engaging member 200 in FIG. 2, one or more of ground engaging members 122 may have a substantially three-pointed star cross-sectional shape in a substantially horizontal plane. In some embodiments, one or more ground engaging members 122 may have a substantially three-pointed star cross-sectional shape over substantially the entire height of ground engaging member 122. Accordingly, first ground engaging member 200 may extend from a region of outer member 116 in a substantially three-pointed star shape to a central tip 202 located around an apex 204 of first ground engaging member 200. Central tip 202 may be curved or rounded in some embodiments. Apex 204 may represent the point on first ground engaging member 200 farthest from outer member 116.

In different embodiments, ground engaging members 122 may include one or more arm portions 206. In some embodiments, arm portions 206 may extend substantially radially from a central region 208, as shown with respect to first ground engaging member 200. In some embodiments, one or more arm portions 206 may extend in a substantially non-radial direction from central region 208. In other embodiments, all arm portions 206 of a single ground engaging member may extend radially from central region 208 of the ground engaging member.

In some embodiments, central region 208 may include different shapes. In the embodiment of FIG. 2, central region 208 includes a triangular shape in the horizontal plane. In other embodiments, central region 208 may include a circular, square, or other polygonal shape. Central region 208 and central tip 202 are not intended to demarcate a precise area of the ground engaging member. Rather, they are intended to represent general relative areas of the ground engaging member to aid in the following discussion.

In some embodiments, a majority of ground engaging members 122 may each include three arm portions 206, extending outward in a radial direction. For example, in FIG. 2, first ground engaging member 200 shown in the enlarged view includes a first arm portion 210, a second arm portion 212, and a third arm portion 214. Each arm portion begins near central region 208 and terminates at a vertex 216. A midline on each arm portion may be seen that moves from apex 204 to each vertex 216. First arm portion 210 includes a first midline 218, second arm portion 212 includes a second midline 220, and third arm portion 214 includes a third midline 222.

In different embodiments, arm portions 206 may have various shapes. In some embodiments, arm portions 206 may include a generally oblong triangular shape. In other embodiments, vertices 216 may include an intersection of edges that is more pointed, or less pointed, than that depicted in FIG. 2. In other words, edge of vertex 216 may be more rounded or curved, or may be more narrow or sharp. Furthermore, arm portions 206 may be non-linear in some embodiments. For example, in some embodiments, arm portions 206 may extend outward from central region 208 and include a curved geometry. In different embodiments, first arm portion 210, second arm portion 212, and third arm portion 214 of first ground engaging member 200 may be shaped similarly to one another, or they may each have different shapes.

In different embodiments, the width of an arm portion 206 in the horizontal plane may vary from central region 208 to vertex 216. In some embodiments, there can be a first width 221 that is closer to central region 208, and a second width 223 that is closer to vertex 216. In some embodiments, first width 221 is larger than second width 223. In other embodiments, first width 221 may be substantially equivalent to second width 223, or may be smaller.

In some embodiments, the geometry of ground engaging members 122 can generally demarcate outer surface of outer member 116 into smaller areas. As seen in FIG. 2, outer member 116 includes a regular pattern of outer member areas 272 that lie between or adjacent to arm portions 206 of adjacent ground engaging members 122. In some embodiments, outer member areas 272 may be generally triangular. In other embodiments, outer member 116 may be demarcated in a different arrangement or geometrical pattern and provide outer member areas 272 of different shape or size. In some embodiments, outer member areas 272 may be curved or otherwise irregular, rather than linearly shaped. In other embodiments, the appearance of outer member areas 272 may be related to the shape, size, and arrangement of ground engaging members 122 included.

In some embodiments, different areas of a ground engaging member may function as a hinge, permitting the turning or movement of adjacent parts. In particular, in some embodiments, edges connecting adjacent portions of material may rotate about a hinge portion 283 associated with the edge of the ground engaging member. In different embodiments, ground engaging members 122 may include one or more hinge portions 283. In some embodiments, each arm portion 206 of ground engaging members 122 may include one or more hinge portions 283. Hinge portions 283 may at least in part provide sole structure 102 with the auxetic properties described in this description. In other words, ground engaging members 122 may be able to move about the regions associated with hinge portions 283 in some embodiments. In some embodiments, at least some of hinge portions 283 may be rounded with a convex geometry.

In one example, each edge of ground engaging member 200 can be associated with a corresponding hinge portion 283. In FIG. 2, it can be seen that first ground engaging member 200 includes twelve hinge portions. First arm portion 210 includes a first hinge portion 284 and a second hinge portion 285. Second arm portion 212 includes a third hinge portion 286 and a fourth hinge portion 287. Third arm portion 214 includes a fifth hinge portion 288 and a sixth hinge portion 289. Furthermore, first midline 218 of first arm portion 210 may be associated with a seventh hinge portion, second midline 220 of second arm portion 212 may be associated with an eighth hinge portion, and third midline 222 of third arm portion 214 may be associated with a ninth hinge portion. In addition, first arm portion 210 of first ground engaging member 200 may be disposed adjacent to and joined along a tenth hinge portion 233 to neighboring second arm portion 212. Likewise, second arm portion 212 may be joined along an eleventh hinge portion 235 to adjacent third arm portion 214. Third arm portion 214 may also be joined along a twelfth hinge portion 237 to first arm portion 210. In other embodiments, arm portions 206 may include a lesser or greater number of hinge portions 283.

In some embodiments, each of the remaining edges and/or midlines of ground engaging members 122 may be associated with hinged areas or hinge portions that join adjacent polygonal portions in a rotatable manner. The characteristics of hinge portions 283 may be related to the type of shape or geometry selected for ground engaging members 122. In other embodiments, ground engaging members 122 may not include hinge portions 283.

In different embodiments, hinge portions 283 can be associated with and/or comprised of a relatively small portion of material adjoining or connecting various faces, or sides, of the various polygonal or irregular portions forming the auxetic structure. In some embodiments, ground engaging members 122 include a plurality of faces. In one embodiment, the faces associated with ground engaging members 122 are substantially flat.

Hinge portions 283 may also provide a connecting portion between arm portions 206 and a portion of outer member 116, such as outer member areas 272. In other words, some hinge portions 283 may provide a region of attachment for the various faces or portions comprising ground engaging members 122 to sole structure 102 and/or outer member 116.

In some embodiments, ground engaging members 122 may include six faces. For example, in FIG. 2, a first face 290 and a second face 291 forming two sides or portions of first arm portion 210 are depicted. First face 290 and second face 291 may be joined, rotated or bent with respect to one another along the seventh hinge portion associated with first midline 218. First face 290 may also be joined, moved, rotated, or bent along first hinge portion 284 with respect to a first outer member area 296 of sole structure 102, and second face 291 may be connected, moved, rotated, or bent along second hinge portion 285, with respect to a second outer member area 297 of sole structure 102. In a similar manner, a third face 292 and a fourth face 293 form two sides or portions of second arm portion 212. Third face 292 and fourth face 293 may join, rotate or bend with respect to one another along the eighth hinge portion associated with second midline 220. Third face 292 may also be joined, moved, rotated or bent along third hinge portion 286 with respect to second outer member area 297, and fourth face 293 may be connected, moved, rotated, or bent along fourth hinge portion 287 with respect to a third outer member area 298. In addition, third arm portion 214 may be comprised of two sides, including a fifth face 294 and a sixth face 295. Fifth face 294 and sixth face 295 may join, rotate or bend with respect to one another at the ninth hinge portion associated with third midline 222. Fifth face 294 may be connected, moved, rotated, or bent along fifth hinge portion 288 with respect to third outer member area 298, and sixth face 295 may be joined, moved, rotated, or bent along sixth hinge portion 289 with respect to first outer member area 296.

As seen in FIG. 2, a portion, or one end, of each face may also be associated with an apex 204. Thus, in one embodiment, each face may extend from base portion 120 to apex 204. In other embodiments, each face may be joined to two adjacent faces.

In some embodiments, two adjacent arm portions 206 may form various angles. In the embodiment of FIG. 2, the three arm portions associated with first ground engaging member 200 form three angles, identified as angle 224, angle 225, and angle 226. First arm portion 210, second arm portion 212, and third arm portion 214 are disposed so that each pair of adjacent arm portions form substantially equivalent obtuse angles. In other embodiments, the angles formed by a pair of adjacent arm portions may differ from one another. In some embodiments, any angles formed by a pair of adjacent arm portions may be acute or right angled. It should be noted that the magnitudes of angle 224, angle 225, and angle 226 may increase or decrease as the auxetic structure of sole structure 102 undergoes expansion or compression. In particular, as tenth hinge portion 233, eleventh hinge portion 235, and/or twelfth hinge portion 237 permit movement of various regions of first ground engaging member 200, corresponding angle 224, angle 225, and angle 226 can change.

In different embodiments, the orientation of one or more arm portions 206 may differ significantly, or may be substantially similar. In the embodiment of FIG. 2, first arm portion 210, second arm portion 212, and third arm portion 214 are each oriented along a different direction. In other words, each midline of first arm portion 210, second arm portion 212, and third arm portion 214 is oriented along a different axis. In some embodiments, first midline 218 may be oriented along a first direction 230, second midline 220 may be oriented along a second direction 232, and third midline 222 may be oriented along a third direction 234. As seen in FIG. 2, first direction 230 and third direction 234 are oriented so that they extend diagonally relative to a lateral direction 236, extending from a medial side 238 to a lateral side 240 of sole structure 102. Second direction 232 is oriented so that it extends approximately from forefoot region 110 to heel region 114 of sole structure 102.

In different embodiments, the orientation of adjacent ground engaging members 122 may vary or be substantially similar to the orientation of first ground engaging member 200. In other words, the midlines of arm portions 206 of ground engaging members 122 may lie along or near substantially the same axis as the respective midlines of the three arm portions of first ground engaging member 200 in some embodiments. For example, in FIG. 2, ground engaging members adjacent to first ground engaging member 200 include second ground engaging member 242, third ground engaging member 244, fourth ground engaging member 246, fifth ground engaging member 248, sixth ground engaging member 250, and seventh ground engaging member 252. The midlines of a first arm portion 254 of second ground engaging member 242, first arm portion 210 of first ground engaging member 200, and a first arm portion 256 of third ground engaging member 244 may generally lie along first direction 230. The midlines of a second arm portion 258 of fourth ground engaging member 246, second arm portion 212 of first ground engaging member 200, and a second arm portion 260 of fifth ground engaging member 248 may generally lie along second direction 232. The midlines of a third arm portion 262 of sixth ground engaging member 250, third arm portion 214 of first ground engaging member 200, and a third arm portion 264 of seventh ground engaging member 252 may lie along third direction 234. In some embodiments, other ground engaging members 122 may include arm portions 206 that lie along axes that are substantially parallel to first direction 230, second direction 232, and third direction 234.

In other embodiments, ground engaging members 122 may be disposed along different orientations or arrangements. It should be noted that in different embodiments, first direction 230, second direction 232, third direction 234, and/or any other axis along which ground engaging members are arranged may be non-linear. In some embodiments, adjacent ground engaging members 122 may lie along an axis that is curved, for example. In other embodiments, ground engaging members 122 may be disposed in a staggered arrangement.

Providing all, or substantially all, of ground engaging members 122 so that an arm portion generally lies along first direction 230, second direction 232, or third direction 234, or axes parallel to first direction 230, second direction 232, or third direction 234 may maximize the benefits discussed above regarding the characteristics of traction in medial side 238 to lateral side 240 (i.e., side-to-side) directions. Such configurations may provide increased performance in terms of traction supporting agility in lateral direction 236.

In different embodiments, two adjacent ground engaging members 122 may be disposed at various distances from one another. In some embodiments, ground engaging members 122 may be disposed at regular intervals from one another. In other embodiments, there may be greater space, or areas of outer member 116, between one ground engaging member and another ground engaging member. In the embodiment of FIG. 2, first ground engaging member 200 and sixth ground engaging member 250 are adjacent to one another so that third arm portion 262 of sixth ground engaging member 250 generally abuts the area near central region 208 of first ground engaging member 200 within the obtuse angle formed by second arm portion 212 and third arm portion 214 of first ground engaging member 200. Other ground engaging members 122 may be disposed in a similar arrangement adjacent to areas of outer member 116. In one embodiment, ground engaging members 122 that generally lie along a single axis may be disposed so that they are at substantially the same distance from one another. For example, in FIG. 2, a first distance 227 from a first apex 266 to a second apex 268 may be substantially similar to a second distance 228 from second apex 268 to a third apex 270. In other embodiments, first distance 227 may be less than second distance 228, or first distance 227 may be greater than second distance 228.

In some embodiments, particularly near a perimeter 274 of sole structure 102, ground engaging members 122 may be partially formed. In other words, some ground engaging members 122 may be formed with fewer than three arm portions 206, arm portions 206 that extend for shorter lengths, and/or a central region 208 that is smaller relative to the central regions of other ground engaging members disposed farther from perimeter 274. For example, in FIG. 2, an eighth ground engaging member 276 can be seen disposed along perimeter 274 of heel region 114. Eighth ground engaging member 276 includes a first arm portion 278 and a second arm portion 280, similar to arm portions 206 described above. However, a third arm portion 282 of eighth ground engaging member 276 is abbreviated in length relative to first arm portion 278 and second arm portion 280. Thus, in some embodiments, ground engaging members 122 may be formed along or near perimeter 274 of outer member 116 that differ from ground engaging members 122 that are not formed along perimeter 274. In some embodiments, at least one arm portion of each ground engaging member disposed along perimeter 274 may be shorter than the arm portions 206 of the ground engaging members disposed further from perimeter 274. In other embodiments, there may be fewer than three arm portions 206 included for one or more ground engaging members 122 that are disposed along perimeter 274. In one embodiment, a ground engaging member near perimeter 274 may include only a single arm portion 206, or a partially formed arm portion.

Materials and configurations for outer member 116 and ground engaging members 122 may be selected according to the type of activity for which article 100 is configured. Outer member 116 and/or ground engaging members 122 may be formed of suitable materials for achieving the desired performance attributes. In one embodiment, outer member 116 and ground engaging members 122 may be comprised of substantially similar materials. In different embodiments, for example, outer member 116 and/or ground engaging members 122 may be formed of any suitable polymer, rubber, composite, and/or metal alloy materials. Examples of such materials may include thermoplastic and thermoset polyurethane (TPU), polyester, nylon, glass-filled nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In one embodiment, outer member 116 and/or ground engaging members 122 are made of a substantially elastic material.

In some embodiments, outer member 116, or portions of outer member 116 and ground engaging members 122, may be formed of a composite of two or more materials, such as carbon-fiber and poly-paraphenylene terephthalamide. In some embodiments, these two materials may be disposed in different portions of outer member 116 and/or ground engaging members 122. Alternatively, or additionally, carbon fibers and poly-paraphenylene terephthalamide fibers may be woven together in the same fabric, which may be laminated to form outer member 116. Other suitable materials, including future-developed materials, will be recognized by those having skill in the art.

Different structural properties may be desired for different aspects of outer member 116 and/or ground engaging members 122. Therefore, the structural configuration may be determined such that, even though a common material is used for all portions of outer member 116 and/or ground engaging members 122, the different portions may be stiffer, or more flexible due to different shapes and sizes of the components. In different embodiments, for example, heel region 114 and midfoot region 112 of outer member 116 may be formed of a thicker material and/or may include reinforcing features, such as ribs, in order to provide stiffness to these portions of outer member 116, whereas forefoot region 110 of outer member 116, particularly a region of outer member 116 corresponding with the ball of the foot, may be formed of a relatively thin material, in order to provide flexibility to forefoot region 110. Greater flexibility in forefoot region 110 may enable natural flexion of the foot during running or walking, and may also enable outer member 116 to conform to surface irregularities, which may provide additional traction and stability on such surfaces. In addition, ground engaging members 122 may be formed at least in part with a thicker structure to provide rigidity and strength in some embodiments.

In different embodiments, outer member 116 and/or ground engaging members 122 may be formed by any suitable process. For example, in some embodiments, outer member 116 and/or ground engaging members 122 may be formed by molding. In addition, in some embodiments, various elements of outer member 116 and/or ground engaging members 122 may be formed separately and then joined in a subsequent process. Those having ordinary skill in the art will recognize other suitable processes for making outer members 116 and/or ground engaging members 122 discussed in this disclosure.

In some embodiments, outer member 116, ground engaging members 122, and other elements of outer member 116 may be integrally formed. For example, in some embodiments, the entirety of outer member 116 may be formed of a single material, forming all parts of outer member 116. In such embodiments, outer member 116 may be formed all at once in a single molding process, for example, with injection molding.

In other embodiments, different portions of sole structure 102 may be formed of different materials. For example, a stiffer material, such as carbon fiber, may be utilized in heel region 114 and/or midfoot region 112 of outer member 116, whereas a more flexible material, such as a thin polyurethane, may be used to form forefoot region 110 of outer member 116. In addition, it may be desirable to utilize a stiffer and/or harder material for outer member 116 in some embodiments, such as carbon-fiber and/or polyurethane, and softer and more flexible material for ground engaging members 122, such as a relatively hard rubber. For example, some parts of outer member 116 may be made by molding a hard rubber or polyurethane to form the polygonal features.

Accordingly, in some embodiments, outer member 116 and/or ground engaging members 122 may be formed by multiple molding steps, for example, using a co-molding process. For instance, outer member 116 may be pre-molded, and then inserted into an outer member mold, into which the ground engaging member material may be injected to form ground engaging members 122, or portions of ground engaging members 122. In other embodiments, ground engaging members 122 may be pre-molded and outer member 116 may be co-molded with the pre-formed ground engaging members. In addition, other components of outer member 116, such as reinforcing elements, may be formed of different materials.

In some embodiments, outer member 116 and ground engaging members 122 may be made separately and then engaged with one another (e.g., by mechanical connectors, by cements or adhesives, etc.). In some embodiments, ground engaging members 122 and other sole components may be integrally formed as a unitary, one piece construction (e.g., by a molding step). In some embodiments, at least some portions of sole structure 102 (e.g., outsole or outer member components) may be affixed to one another or formed together as a unitary, one-piece construction, e.g., by selective laser sintering, stereolithography, or other three dimensional printing or rapid manufacturing additive fabrication techniques. These types of additive fabrication techniques allow the ground engaging members 122, outer member 116, and/or other components of sole structure 102 to be built as unitary structures.

Figure 3:
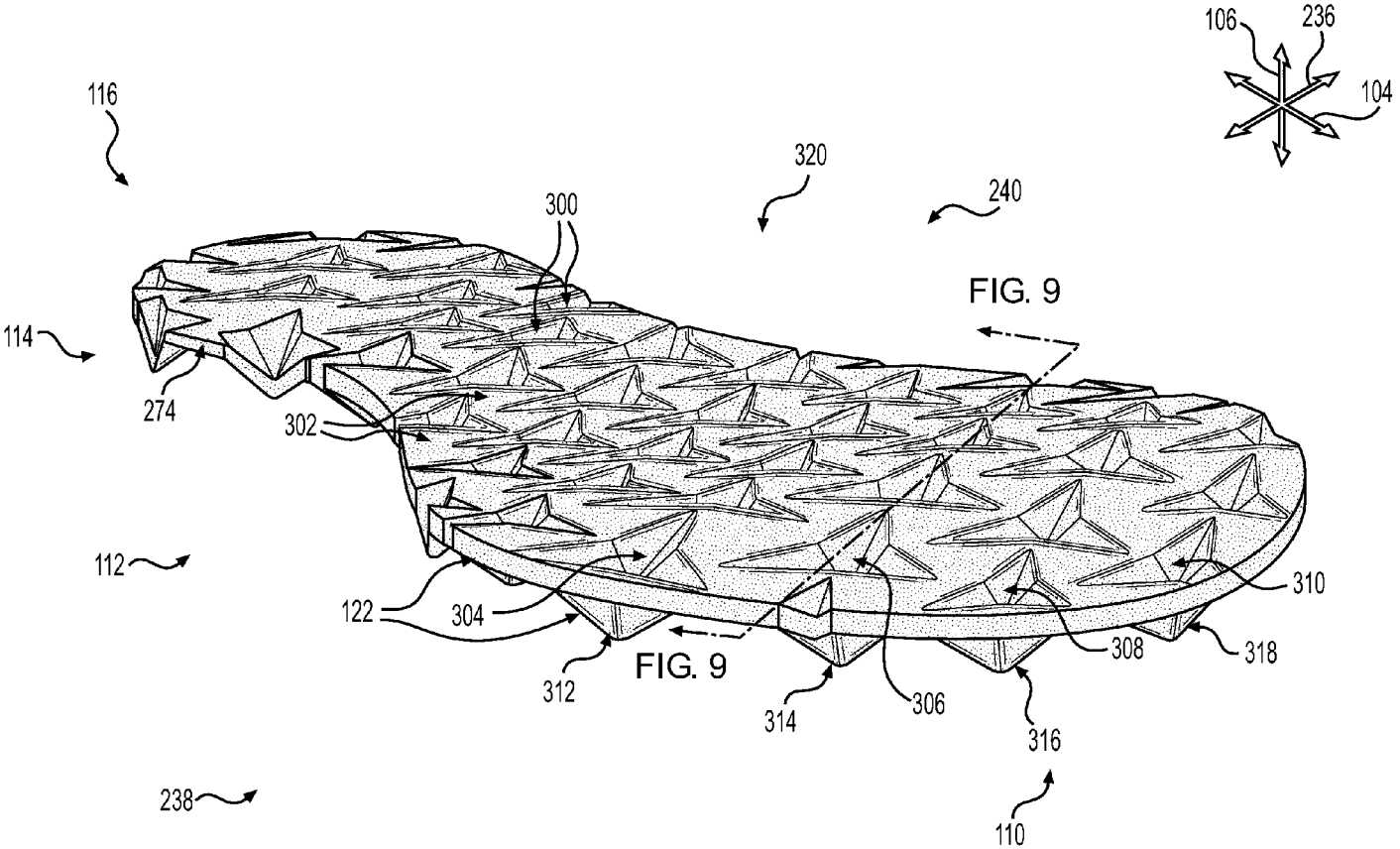
FIG. 3 is an isometric illustration of the inner surface of an embodiment of an outer member for an article of footwear.

FIG. 3 illustrates an isometric view of an inner side 320 of an embodiment of outer member 116 for a sole structure. Outer member 116 may include apertures 300 disposed along inner surface or inner side 320 of outer member 116 in some embodiments. In one embodiment, apertures 300 may comprise a hollow interior region that is bounded by the plurality of faces associated with ground engaging members 122 on the outer side of outer member 116. The hollow interior region can be open on an inner side of outer member 116. In particular, apertures 300 may correspond to a concave interior side of ground engaging members 122. Apertures 300 may extend in vertical direction 106 through outer member 116.

In different embodiments, apertures 300 may be configured in varying geometric patterns. In some embodiments, apertures 300 may include concave features. In other embodiments, apertures 300 may include various hinges or predetermined regions of bending. In one embodiment, when apertures 300 are vertically compressed they can unfold and extend in a horizontal direction. In some embodiments, there may be multiple apertures 300 arranged on sole structure 102, and in one embodiment, apertures 300 may function together to provide auxetic structure to outer member 116.

In some embodiments, apertures 300 may comprise openings in outer member 116. In different embodiments, apertures 300 may be any shape, size, depth, or geometry. In some embodiments, various polygonal openings or other irregularly shaped openings may be used to form apertures 300, such as triangular, quadrilateral, pentagonal, hexagonal, heptagonal, octagonal, or other irregular features. In other embodiments, apertures 300 may be polygonal, and may form three-pointed star-shaped openings, four-pointed star-shaped openings, five-pointed star-shaped openings, or six-pointed star-shaped openings.

In one example, as shown in FIG. 3, inner side 320 of outer member 116 bears a pattern of triangular, or three-pointed, star-shaped apertures 300, bounded by a pattern of base areas 302. In different embodiments, base areas 302 may be configured in varying geometric patterns. In some embodiments, base areas 302 may include generally flat or plate-like features. In other embodiments, base areas 302 may include various hinges or predetermined regions of bending for greater flexibility. In other embodiments base areas 302 may be relatively inflexible. In some embodiments, there may be multiple base areas 302 arranged on sole structure 102, and in one embodiment, base areas 302 may function together to provide auxetic structure to outer member 116.

In some embodiments, base areas 302 may comprise variously shaped portions in outer member 116. In different embodiments, base areas 302 may be any shape, size, thickness, or geometry. In some embodiments, various polygonal shapes or other irregularly shape portions may comprise base areas 302, such as round, curved, elliptical, triangular, quadrilateral, pentagonal, hexagonal, heptagonal, octagonal, or other irregular features. In one embodiment, base areas 302 may be generally triangular.

In one case, base areas 302 may be separated by apertures 300 so that base areas 302 are completely enclosed and separated from one another. In other cases, base areas 302 are partially enclosed so that some base areas 302 can touch or abut adjacent base areas 302, as depicted in FIG. 3.

In different embodiments, apertures 300 may be disposed in various arrangements along outer member 116. In some embodiments, apertures 300 may be disposed in a uniform pattern along outer member 116. In other embodiments, apertures 300 may be disposed in only some areas of outer member 116.

In different embodiments, apertures 300 may align or correspond with ground engaging members 122 that are located on the outer side of outer member 116. In other embodiments, ground engaging members 122 may be disposed on an outer side of outer member 116, but the opposite side of outer member 116 may be solid, or "filled in," so that there is no corresponding aperture 300. In one embodiment, apertures 300 may be present but there may be no corresponding ground engaging member 122. In another embodiment, there may be ground engaging members 122 and corresponding apertures 300, but they may differ significantly in size or shape from one another. In the embodiment of FIG. 3, apertures 300 generally correspond to ground engaging members 122 disposed on the opposite side of outer member 116. As seen in forefoot region 110, and along perimeter 274 of outer member 116, there is a first aperture 304 which is aligned with a first ground engaging member 312, a second aperture 306 aligned with a second ground engaging member 314, a third aperture 308 aligned with a third ground engaging member 316, and a fourth aperture 310 aligned with a fourth ground engaging member 318. This type of arrangement may be repeated throughout outer member 116, or it may differ. Moreover, it may be understood that base areas 302 on inner side 320 may generally correspond with outer member areas 272 on outer side 299 of outer member 116.

In some embodiments, the shape of apertures 300 in the horizontal plane may be substantially similar to the shape of corresponding ground engaging members 122 in the horizontal plane. In other embodiments, some areas of outer member 116 may include apertures 300 and ground engaging members 122 that are similar shapes, and other areas may include apertures 300 and ground engaging members 122 are different shapes.

Figure 5:
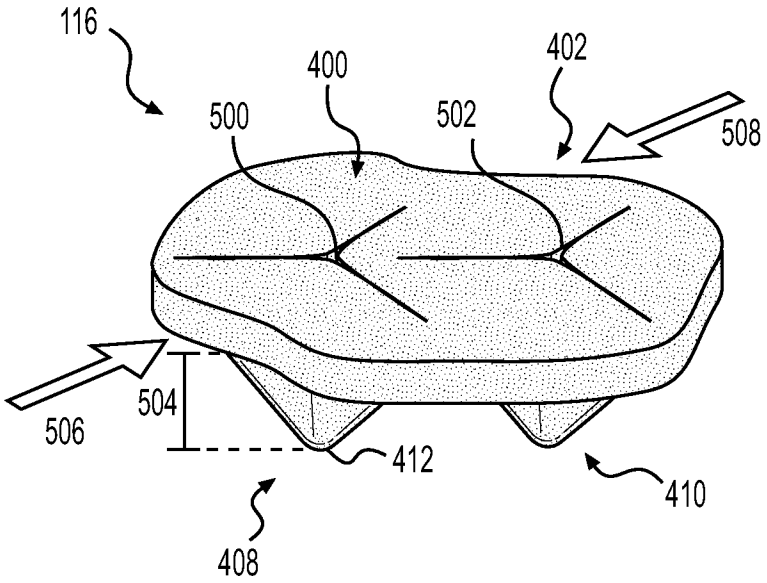
FIG. 5 is a schematic illustration of the inner surface of an embodiment of a portion of the outer member.
Figure 4:
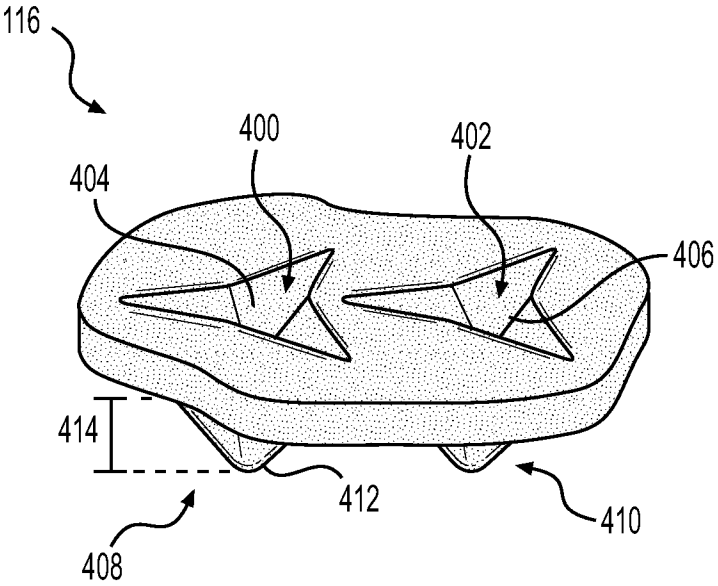
FIG. 4 is an isometric view of the inner surface of an embodiment of a portion of the outer member.

During deformations as described above, ground engaging members 122 may expand or compress in different embodiments in different embodiments. FIGS. 4-8 depict a cutaway portion of outer member 116. In FIGS. 4 and 5, a first aperture 400 and a second aperture 402 in outer member 116 are depicted, with portions of corresponding first ground engaging member 408 and second ground engaging member 410 visible below outer member 116. In FIG. 4, first aperture 400 has an opening with a first aperture area 404, and second aperture 402 similarly has an opening with a second aperture area 406. In some embodiments, the openings lie generally in the horizontal plane along the upper surface of outer member 116. The area of each opening may be enclosed by the perimeter edges of each aperture.

When a compressive force is applied, for example near the perimeter of outer member, the areas of the openings of first aperture 400 and second aperture 402 may change in some embodiments. In FIG. 5, a first compressive force 506 and a second compressive force 508 are represented by arrows. As a result of the application of compressive force 506 and compressive force 508, the areas of first aperture 400 and second aperture 402 have decreased. The opening of first aperture 400 has a third aperture area 500, and the opening of second aperture 402 has a fourth aperture area 502. Third aperture area 500 is less than first aperture area 404 and fourth aperture area 502 is less than second aperture area 406.

In some embodiments, the shape of the apertures may also change. Depending on the magnitude and the direction of the force(s) applied, the changes in area or shape may vary. In some embodiments, a different force may permit an expansion of the aperture areas. For example, in one embodiment, the outer member may be exposed to a force whereby third aperture area 500 is greater than first aperture area 404, and/or fourth aperture area 502 is greater than second aperture area 406. In one embodiment, the area of an aperture may increase when a compressive force is applied in the vertical direction.

Exposure to various forces may also produce a change in the shape or geometry, size, and/or height of ground engaging members. In FIG. 4, first ground engaging member 408 has an apex 412 at a first height 414. In some embodiments, the height of apex 412 lies generally in the vertical plane of the outer member and extends from the bottom side of the outer member toward the ground. For example, when a first force 506 and a second force 508 are applied, the height of first ground engaging member 408 may change. In FIG. 5, the height of apex 412 of first ground engaging member 408 is increased to a second height 504. In the embodiments of FIGS. 4 and 5, second height 504 is greater than first height 414.

In other embodiments, second height 504 may be substantially similar to or less than first height 414 as various forces are applied to article of footwear 100. In some embodiments, the overall geometry of the ground engaging members may also change. Depending on the magnitude and the direction of the force(s) applied, changes in area or shape may vary. In some embodiments, a different force may permit an expansion of the ground engaging member(s). In some cases, this expansion occurs in the horizontal direction. For example, in one embodiment, the outer member may be exposed to a force whereby second height 504 is less than first height 414.

Figure 6:
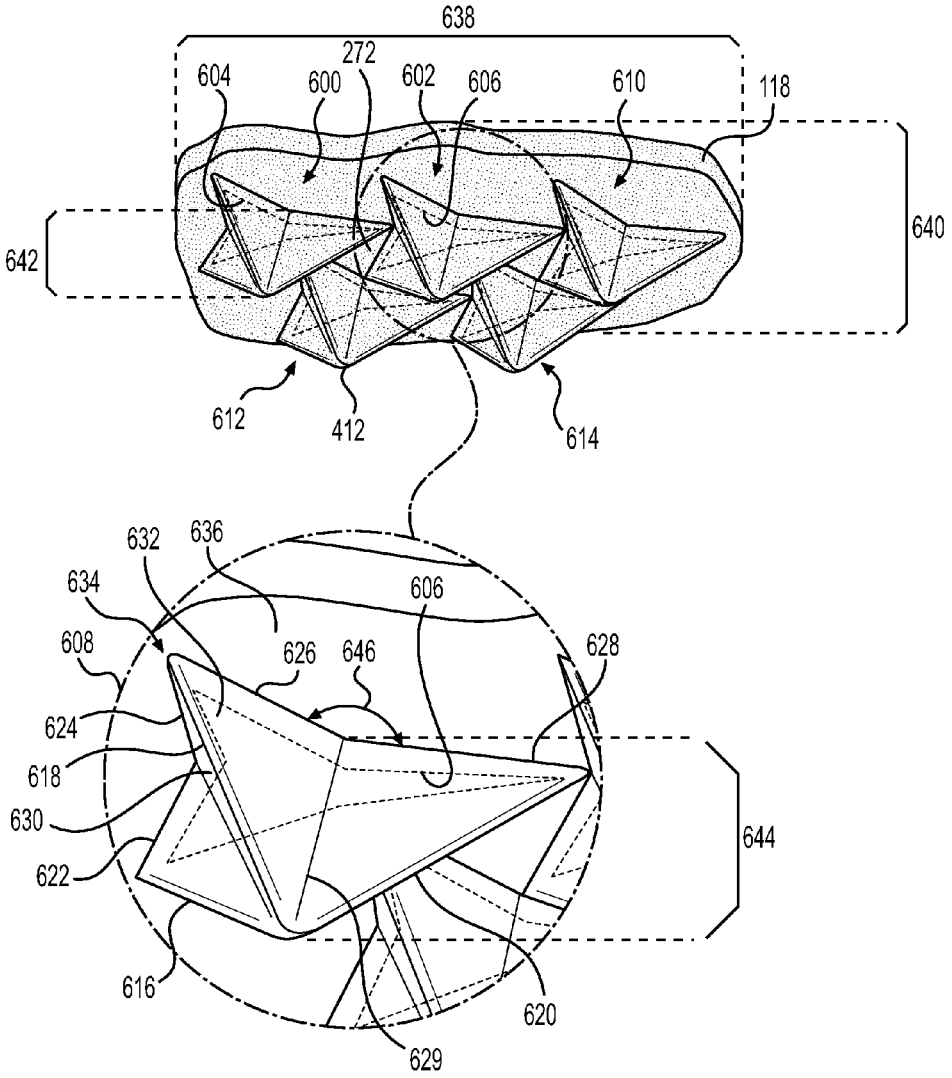
FIG. 6 is an isometric view of the outer surface of an embodiment of a portion of the outer member.
Figure 7:
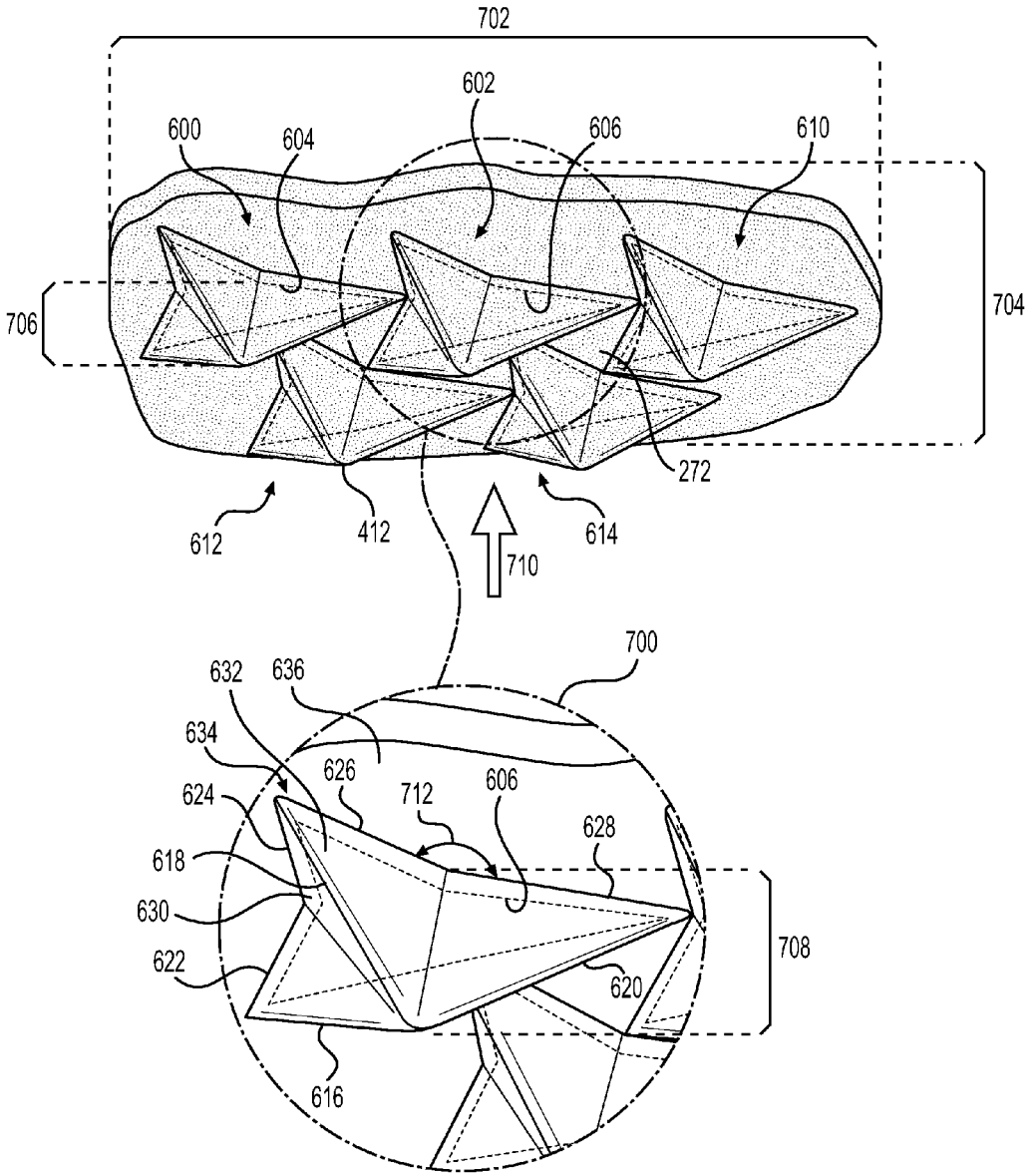
FIG. 7 is an isometric view of the outer surface of an embodiment of a portion of the outer member.
Figure 8:
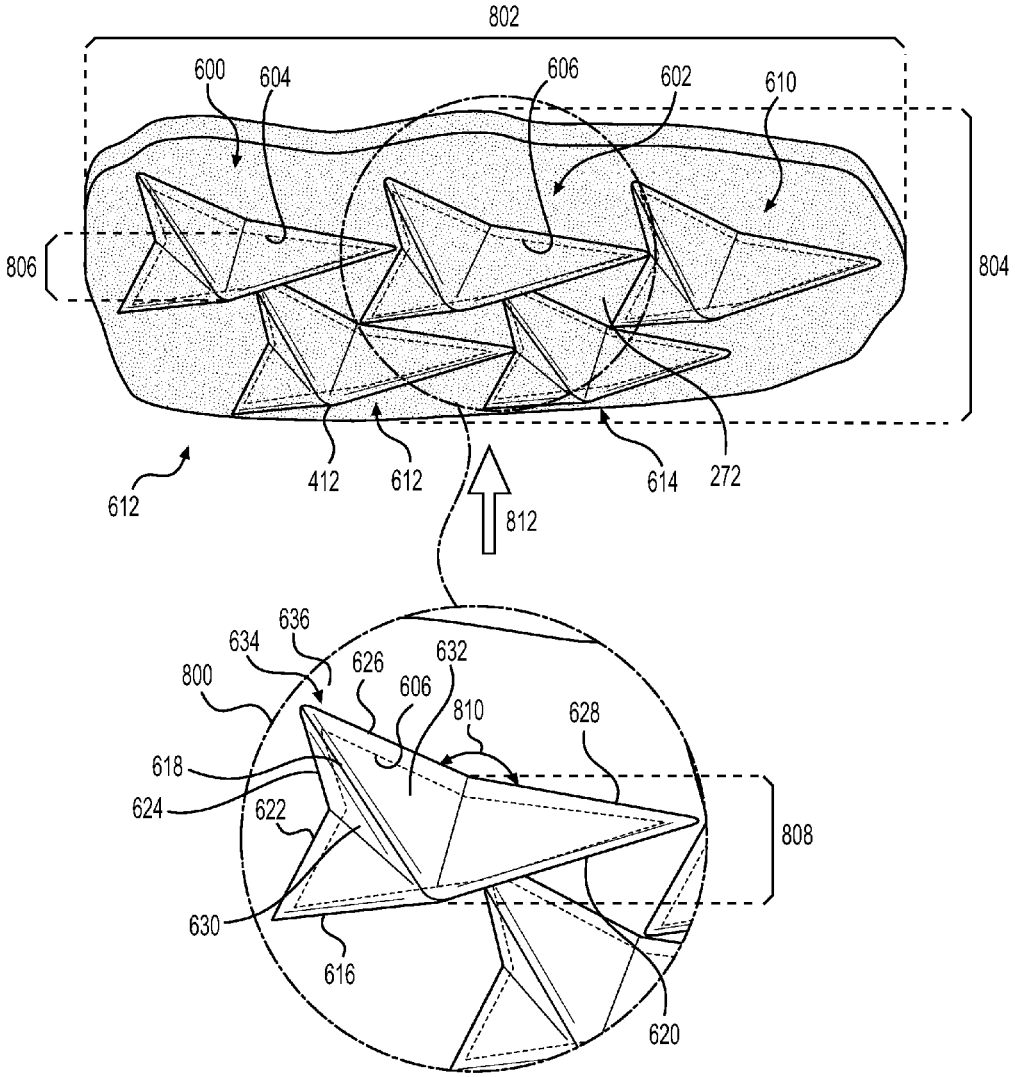
FIG. 8 is an isometric view of the outer surface of an embodiment of a portion of the outer member.

In FIGS. 6, 7, and 8, an embodiment of a portion of outer member 116 is shown. The portion of outer member 116 includes a first ground engaging member 600, a second ground engaging member 602, a third ground engaging member 610, a fourth ground engaging member 612, and a fifth ground engaging member 614. Dotted lines represent apertures corresponding to the ground engaging members, including, for example, a first aperture 604 corresponding to first ground engaging member 600, and a second aperture 606 corresponding to second ground engaging member 602.

In FIG. 6, first ground engaging member 600 has an apex 412 at a third height 642, and, as seen in magnified area 608, second ground engaging member 602 has an apex 412 at a fourth height 644. In some embodiments, the height of each apex 412 lies generally in the vertical plane of the outer member and extends from the bottom side of outer member toward the ground.

When a compressive force is applied, for example near the perimeter of the outer member, the heights of the ground engaging members may change. In FIG. 7, a third compressive force 710, is represented by an arrow. As a result of the application of third compressive force 710, the heights of first ground engaging member 600, second ground engaging member 602, third ground engaging member 610, fourth ground engaging member 612, and fifth ground engaging member 614 are decreased relative to the embodiment of FIG. 6. For example, first ground engaging member 600 has a fifth height 706, and, as seen in magnified area 700, second ground engaging member 602 has a sixth height 708. In the embodiments of FIGS. 6 and 7, fifth height 706 is less than third height 642, and sixth height 708 is less than fourth height 644.

If a different compressive force is applied, the heights of ground engaging members may further change. In FIG. 8, a fourth compressive force 812 is represented by an arrow. Fourth compressive force 812 is greater than third compressive force 710. As a result of the application of fourth compressive force 812, the heights of first ground engaging member 600, second ground engaging member 602, third ground engaging member 610, fourth ground engaging member 612, and fifth ground engaging member 614 are decreased relative to the embodiments of FIGS. 6 and 7. For example, first ground engaging member 600 has a seventh height 806, and, as seen in magnified area 800, second ground engaging member 602 has an eighth height 808. In the embodiments of FIGS. 6, 7, and 8, fifth height 706 is less than third height 642, seventh height 806 is less than fifth height 706, sixth height 708 is less than fourth height 644, and eighth height 808 is less than sixth height 708.

The change in height, as well as other changes to size and shape of ground engaging members, may be facilitated by hinge portions of each ground engaging member. For example, second ground engaging member 602 can be seen to include a first hinge portion 616, a second hinge portion 618, a third hinge portion 620, a fourth hinge portion 622, a fifth hinge portion 624, a sixth hinge portion 626, and a seventh hinge portion 628. Moreover, arm portions of second ground engaging member may be connected by hinge portions, for example, an eighth hinge portion 629. Additional hinge portions may be present along the side of second ground engaging member facing away from the viewer. As various forces are applied to second ground engaging member 602, each hinge portion may provide portions of second ground engaging member 602 with the ability to bend, rotate, or otherwise move, relative to other portions of second ground engaging member 602, or relative to other portions of outer member 116. In some embodiments, in order for apex 412 of second ground engaging member 602 to decrease in height, first hinge portion 616, second hinge portion 618, and/or third hinge portion 620 may each allow a splaying outward of the arm portions of second ground engaging member 602, in particular with respect to the two faces associated with each arm portion. For example, second ground engaging member 602 includes an arm portion 634, which has a first face 630 along one side, and a second face 632 along the generally opposing side. Second hinge portion 618 provides a connecting portion between first face 630 and second face 632 that is flexible and permits rotation of one face with respect to the adjoining face. In some embodiments, this feature provides one means for ground engaging members to splay outward.

Furthermore, in different embodiments, fourth hinge portion 622, fifth hinge portion 624, sixth hinge portion 626, seventh hinge portion 628, and other hinge portions disposed along the base of second ground engaging member 602 may allow a flattening or widening of the arm portions of second ground engaging member 602 with respect to their connection to outer member areas 272. For example, arm portion 634 of second ground engaging member 602 includes first face 630 that is adjoining an outer member area 636. Sixth hinge portion 626 provides a connecting portion between first face 630 and outer member area 636 that is flexible, and permits rotation of first face 630 with respect to outer member area 636. In some embodiments, this feature can allow ground engaging members to flatten in the vertical direction and/or expand in the horizontal direction.

Thus, in different embodiments, outer member 116 may experience different types of forces. During wear, foot and ground forces may compress the outer member along a generally vertical direction. In some embodiments, the outer member may be expanded or experience a force so that there is a splaying outward of the geometry of ground engaging member(s). This may occur during vertical compression, e.g., as a wearer exerts weight on article 100. For example, as depicted in FIGS. 7 and 8, third compressive force 710 and/or fourth compressive force 812 can alter the extent of "splay-out" or horizontal expansion of first ground engaging member 600 and second ground engaging member 602, particularly in the horizontal direction. In FIG. 6, two arm portions of second ground engaging member 602 form an obtuse angle 646. In FIG. 7, as a result of third compressive force 710, the two arm portions of second ground engaging member form an obtuse angle 712. In this case, angle 712 is greater than angle 646. Furthermore, in the embodiment of FIG. 8, the two arm portions of second ground engaging member 602 form an obtuse angle 810 after application of fourth compressive force 812. In this case, angle 810 is greater than angle 712. In other embodiments, forces may differ such that angle 712 may be greater than angle 646, and/or angle 810 is greater than angle 712. Furthermore, in some embodiments, the areas of first aperture 604 and second aperture 606 may increase when a compressive force is applied in the vertical direction.

Horizontal tensioning forces may also contribute to the expansion of ground engaging members. For example, when a ground engaging member experiences a horizontal tension due to friction with a ground surface, the ground engaging member may expand both in the direction of the tension, as well as in a direction perpendicular to the tension.

In some embodiments, the increased "splay-out" of first ground engaging member 600, second ground engaging member 602, third ground engaging member 610, fourth ground engaging member 612, and/or fifth ground engaging member 614 may alter the size, shape, and/or other characteristics of outer member 116. For example, in FIG. 6, the depicted portion of outer member has a third length 638, and a third width 640. When one or more ground engaging members are compressed, as by third compressive force 710 in FIG. 7, the depicted portion of outer member 116 has an increased fourth length 702, and an increased fourth width 704. In FIG. 8, the depicted portion of outer member 116 has a fifth length 802 that is greater than fourth length 702, and a fifth width 804 that is greater than fourth width 704. The flattening or splaying of different ground engaging members may thus change, expand, or increase the area of outer member 116 in some embodiments. In one embodiment, the length of outer member 116 may expand to the same extent as the width of outer member as a result of an applied force. In other embodiments, the length of outer member 116 may not increase as much as the width of outer member 116. For example, in some embodiments, fourth length 702 may expand or increase more relative to the expansion that occurs along fourth width 704 in response to the same force. In another embodiment, the width of outer member 116 may not increase as much as the length of outer member 116. For example, in some embodiments, fourth width 704 may expand or increase more relative to the expansion that occurs along fourth length 702 in response to the same force. Thus, the auxetic properties of the ground engaging members may allow various levels of expansion to outer member 116 that increase its size in the horizontal direction.

Depending on the magnitude and the direction of the force(s) applied, changes in area or shape may vary. It should be noted that forces applied in the lateral direction, as seen in FIGS. 4 and 5, may also result in similar changes in ground engaging member shapes, sizes, heights and/or area of outer member 116. For example, a tension may be applied to or along the sides of outer member 116, and may result in the splaying-out of ground engaging members. This can lead to a decrease in the height of the apex, which can create expansion in outer member 116. Thus, forces in the vertical, horizontal, or other directions may result in expansion in multiple directions.

In different embodiments, the overall geometry of the ground engaging members may also change. In some embodiments, a different force may permit ground engaging member(s) to increase in height. For example, in one embodiment, the outer member may be exposed to a force whereby fifth height 706 is greater than third height 642, seventh height 806 is greater than fifth height 706, sixth height 708 is greater than fourth height 644, and/or eighth height 808 is greater than sixth height 708.

Figure 9:
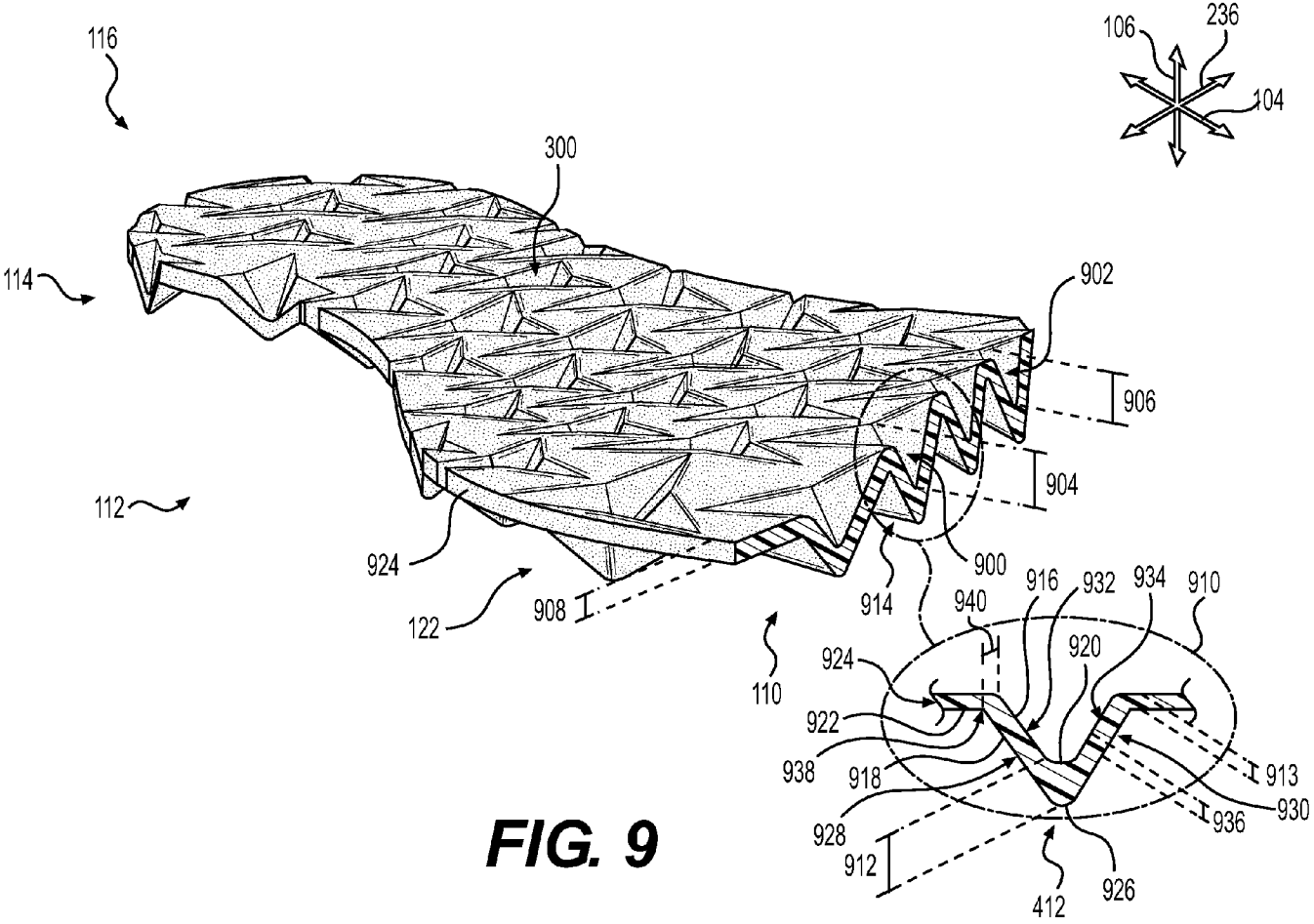
FIG. 9 is a schematic cross-section illustration of an embodiment of the ground engaging outer member shown in FIG. 3.

In different embodiments, the depths of apertures 300 may vary. FIG. 9 depicts a cross-section of the embodiment shown in FIG. 3, along the line labeled FIG. 9. In FIG. 9, it may be seen that the average depth of apertures 300 may be substantially uniform throughout outer member 116. For example, in FIG. 9, a first depth 904 of a first aperture 900 is substantially similar to a second depth 906 of a fourth aperture 902. In other embodiments, there may be differences in the average depth of each aperture. In one embodiment, apertures 300 may extend to a greater depth, where the material comprising any corresponding ground engaging member 122 on outer member 116 is relatively thin. This may permit greater bendability in ground engaging member 122. In another embodiment, depth of apertures 300 may be relatively shallow, so that the material comprising any corresponding ground engaging member 122 is relatively thick. In other words, one or more ground engaging members 122 may be "filled in" to some extent, so that they are at least partially solid rather than hollow. This may permit ground engaging members 122 or cleats to have greater stiffness and provide a more firm response in movements requiring traction.

Additionally, the thickness of outer member 116 may vary in different embodiments. In FIG. 9, it may be seen that the thickness of outer member 116 is substantially uniform throughout some portions of outer member 116. For example, in FIG. 9, a first thickness 908 of a base portion 924 is substantially similar to a second thickness 913 of base portion 924, where the first thickness 908 and the second thickness 913 are taken at different regions of base portion 924. In other embodiments, there may be minor differences in the average thickness of outer member 116 in different regions, allowing variations in the flexibility of outer member 116. In one embodiment, for example, outer member 116 may be thicker in forefoot region 110 than in heel region 114 or midfoot region 112. This may permit greater flexibility to the area of the foot associated with forefoot region 110. In the exemplary embodiment of FIG. 9, outer member areas 922 and/or base portion 924 may have a uniform thickness.

In some embodiments, the thickness of various regions within a ground engaging member 914 can differ in order to provide increased strength and support to ground engaging member 914. In one embodiment, the thickness of apex 412 may differ from the thickness of base portion 924. For example, a third thickness 912 associated with apex 412 can be substantially greater than second thickness 913 associated with base portion 924. In FIG. 9, third thickness 912 of apex 412 is also depicted as substantially greater than first thickness 908 associated with base portion 924 of outer member 116. Such variation in thickness may be necessary to allow ground engaging members 122 to retain their overall shape and structure generally, while also deforming or expanding in response to external forces. As seen in magnified area 910, the varying thicknesses of the material of outer member 116 and ground engaging members 122 contributes to a reinforced layer that stabilizes the flexible nature of the material comprising outer member 116 and ground engaging members 122. The reinforcement of apex 412 with greater thickness can also provide additional traction, strength, and or rigidity to ground engaging member 914 than areas of outer member 116 with lesser thickness.

Furthermore, portions of ground engaging member 914 may have variations in thickness relative to apex 412. For example, ground engaging member 914 includes a first face 928 and a second face 930. First face 928 can include a first intermediate portion 932 extending between apex 412 and base portion 924, and second face 930 may include a second intermediate portion 934 extending between apex 412 and base portion 924. The third thickness 912 associated with apex 412 can be seen to be thicker than a fourth thickness 936 of first intermediate portion 932. In some embodiments, apex 412 is also thicker than second intermediate portion 934.

In some embodiments, the thickness of various portions of faces along ground engaging member 914 may differ from the thickness associated with apex 412. For example, in FIG. 9, first face 928 includes an end portion 938 attached to base portion 924. End portion 938 is associated with a fifth thickness 940. In one embodiment, fifth thickness 940 can differ from third thickness 912 of apex 412. In the embodiment of FIG. 9, fifth thickness 940 is less than third thickness 912. In some embodiments, the thickness of end portion 938 may be similar to the thickness of base portion 924. In FIG. 9, fifth thickness 940 is substantially similar to second thickness 913.

In addition, as seen in magnified area 910, ground engaging member 914 has an outer surface 918 and a corresponding inner surface 916. Inner surface 916 and/or outer surface 918 of ground engaging member 914 can include curved regions. In one embodiment, the portion of inner surface 916 associated with apex 412 includes an inner apex surface 920, and the portion of outer surface 918 associated with apex 412 includes an outer apex surface 926. In particular, inner apex surface 920 and/or outer apex surface 926 may include curved regions. For example, in some embodiments, the area associated with outer apex surface 926 is rounded. In one embodiment, inner surface 916 associated with inner apex surface 920 is also rounded. In some embodiments, the surface of outer apex surface 926 may be convex, and the surface of inner apex surface 920 may be concave.

In different embodiments, the curvatures of inner apex surface 920 and/or outer apex surface 926 may differ. For example, in FIG. 9, the curvature of outer apex surface 926 associated with apex 412 is greater than the curvature of inner apex surface 920 associated with apex 412. In some embodiments, outer apex surface 926 may be characterized as having a smaller radius of curvature than inner apex surface 920.

As noted earlier, in different embodiments, due to the material included in outer member 116 and ground engaging members 122, portions of sole structure 102 may compress and deform to various degrees. For example, in some embodiments, as a result of the application of a deforming force, ground engaging members 122 may expand so that there is greater "splay out" of ground engaging members 122. In such a case, the apex of a ground engaging member may decrease in height, while the arm portions of the same ground engaging member may expand in width. In some embodiments, portions of outer member 116 may in turn also expand.

It should be noted that the various degrees of bending described and shown here are for purposes of illustration. In some situations outer member 116, ground engaging members 122, and/or sole structure 102 may not undergo compression to the extent depicted, or may bend less, depending on various factors such as the materials used in the production of outer member 116 and ground engaging members 122, the manner of attachment to upper 108, or other factors. For example, if outer member 116 is joined or attached to a less reactive material, the compressive and/or expansive properties described herein may differ, or be limited. In some embodiments, when outer member 116 is joined to a strobel or other structure, the capacity of expansion may decrease. In some embodiments, the perimeter of outer member 116 may be fixed, e.g., bonded to a strobel layer. However, in such embodiments the auxetic structure of outer member 116 may still facilitate increased flexibility for portions of outer member 116 even though the dimensions of the perimeter of outer member 116 may not change.

Figure 10:
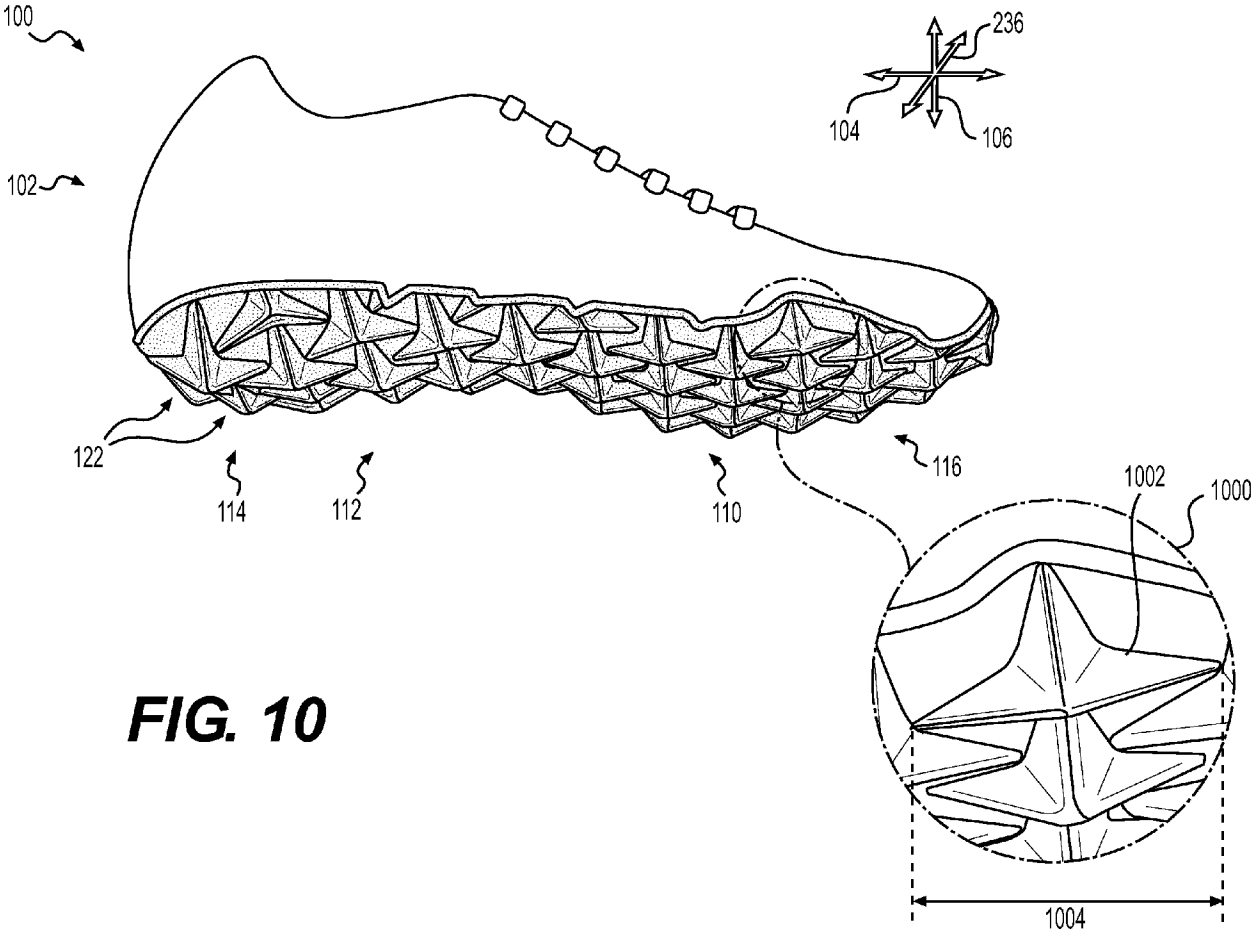
FIG. 10 is an isometric view of the outer surface of an embodiment of an outer member with ground engaging members for an article of footwear.
Figure 11:
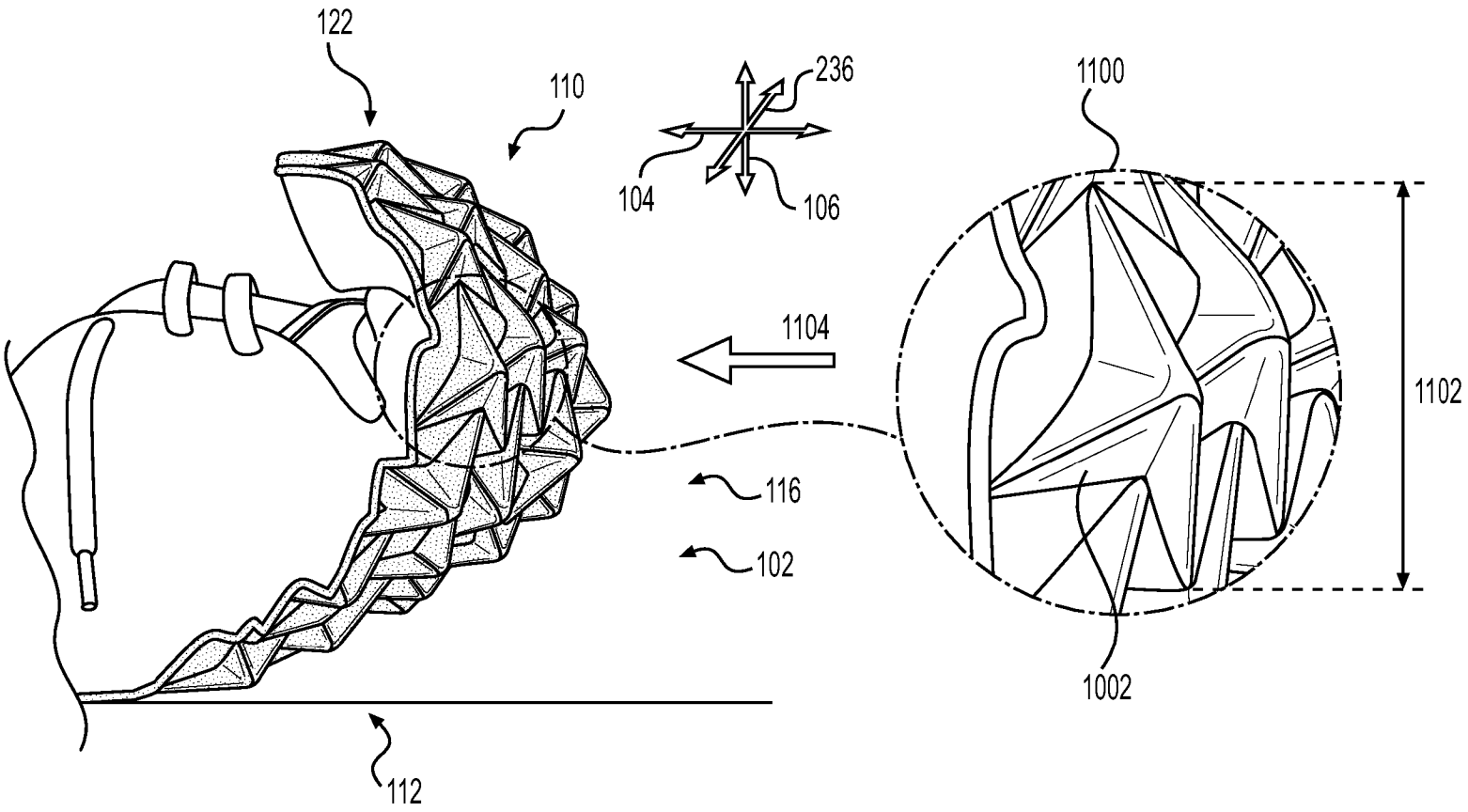
FIG. 11 is an isometric view of the outer surface of an embodiment of an outer member with ground engaging members for an article of footwear undergoing compression forces.

Elasticity and flexibility of a sole component such as sole structure 102 is an important factor associated with comfort for article of footwear 100. In some embodiments, the stiffness of article of footwear 100 can be evaluated by twisting article of footwear 100 in one or more directions. FIGS. 10-13 depict additional embodiments of article of footwear 100. In some embodiments, a force may be applied such that one or more regions are bent. The material(s) selected for sole structure 102 may permit variation in the degree of possible bending. In FIG. 10, article of footwear 100 is shown at rest. In FIG. 11, article of footwear 100 has been bent as a result of a force 1104. Sole structure 102 has been deformed upward from midfoot region 112 so that forefoot region 110 is raised upwards. In other embodiments, the degree of bending may be greater or smaller, depending on the force applied and the materials comprising the structure of article of footwear 100.

Furthermore, in the embodiment of FIG. 10, a ground engaging member 1002 is shown in a magnified area 1000 of sole structure 102. Ground engaging member 1002 has a first width 1004. When forefoot region 110 of outer member 116 is bent upwards, ground engaging member 1002 expands in order to permit bending. In FIG. 11, ground engaging member 1002 has become relatively flatter, and can be seen in magnified area 1100 as expanded to a larger width 1102.

Moreover, article of footwear 100 may be bent along a different axis or plane, further highlighting the high degree of flexibility of sole structure 102. For example, in FIG. 12, article of footwear 100 is shown at rest. In FIG. 13, sole structure 102 of article of footwear 100 has been bent outwards relative to its center line, a longitudinal axis 1208. The bending is a result of a first force 1306 from along lateral side 240 and a second force 1308 from along medial side 238, forming an angle 1310. Sole structure 102 has been deformed upward along its sides so that medial side 238 and lateral side 240 are raised up relative to longitudinal axis 1208. In other embodiments, angle 1310 may be greater or smaller, depending on the force applied and the materials comprising the structure of article of footwear 100.

Figure 12:
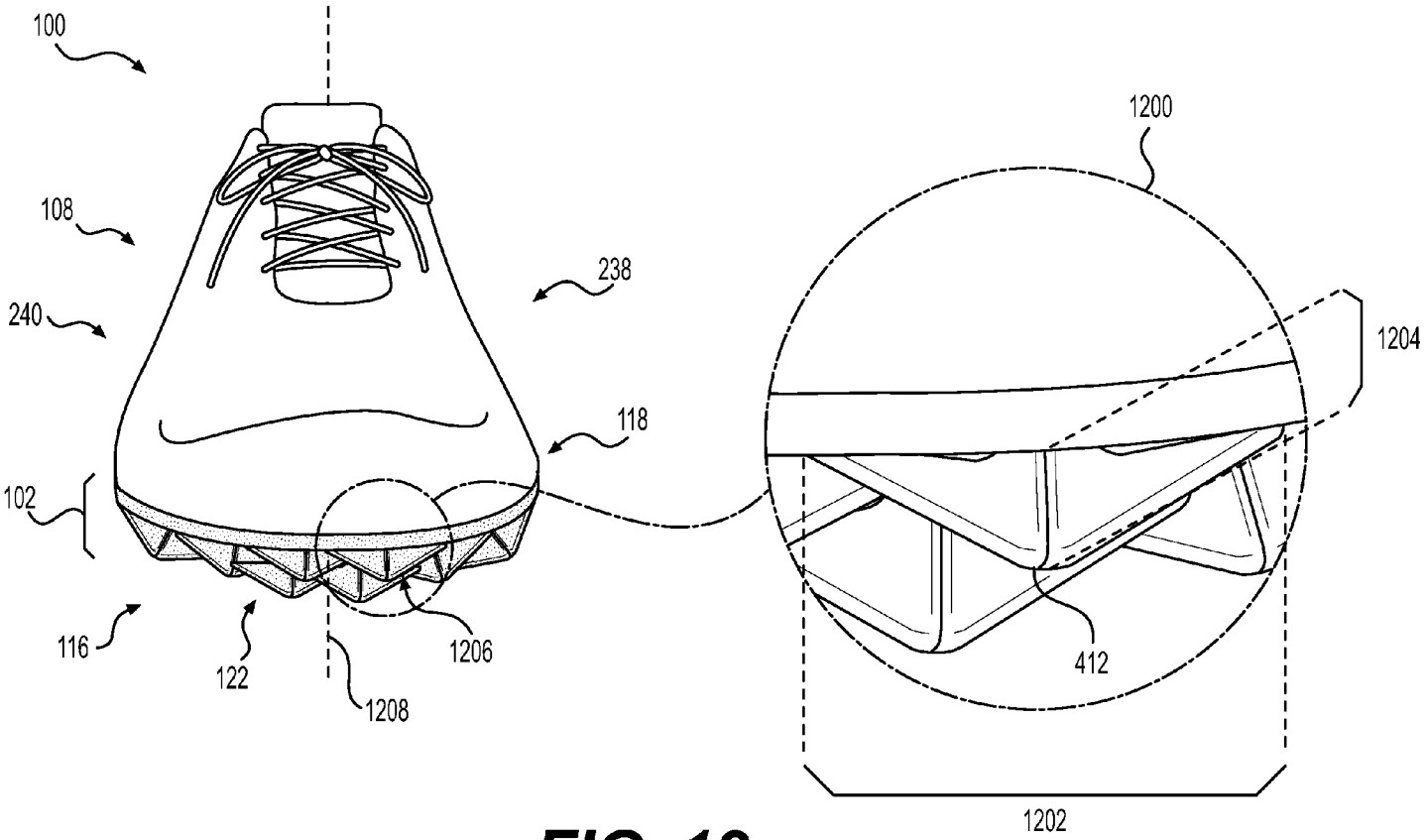
FIG. 12 is a front view of the outer surface of an embodiment of an outer member with ground engaging members for an article of footwear.
Figure 13:
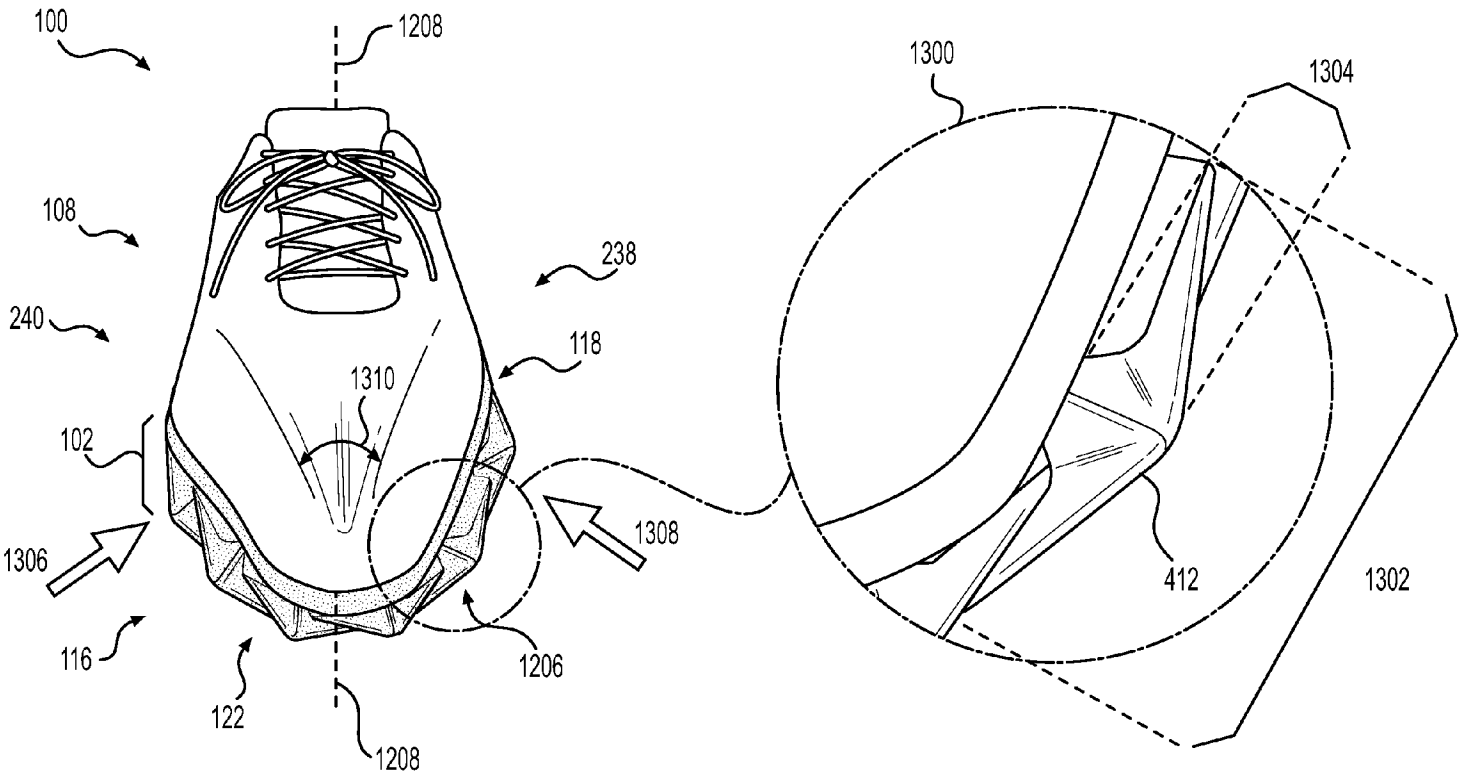
FIG. 13 is a front view of the outer surface of an embodiment of an outer member with ground engaging members for an article of footwear undergoing compression forces.

Furthermore, in the embodiment of FIG. 12, a ground engaging member 1206 is shown in a magnified area 1200 of sole structure 102. Ground engaging member 1206 has a first width 1202. When forefoot region 110 of outer member 116 is bent upwards along longitudinal axis 1208, ground engaging member 1206 expands in order to permit bending. In FIG. 13, width of ground engaging member 1206 has expanded to a larger width 1302 and ground engaging member 1206 become relatively flatter, and can be seen in magnified area 1300. Similarly, in FIG. 12, a first height 1204 of apex 412 of ground engaging member 1206 has decreased, allowing ground engaging member 1206 to flatten, so that first height 1204 is decreased to a second height 1304 in FIG. 13.

Thus, in some embodiments, in response to compressive or other forces, ground engaging members 122 may expand so that one or more ground engaging members 122 "splay out" and increase in surface area along outer member 116. In such a case, the apex of the ground engaging member may decrease in height, while the arm portions of the same ground engaging member may expand in their average width. In some cases, this expansion occurs in the horizontal direction. In some embodiments, outer member 116 may also expand. This may permit extension of sole structure 102 in a way that promotes a higher flexibility of article of footwear 100. Such flexibility can be important to a wearer in order to achieve increased foot mobility. With greater flexibility, impedances to movement may be minimized. An article of footwear which bends with very little pressure or force, allowing the feet to move freely in all directions, may improve performance in a variety of athletic events. In addition, a flexible sole structure 102 can provide a user with a much greater comfort level.

Figure 14:
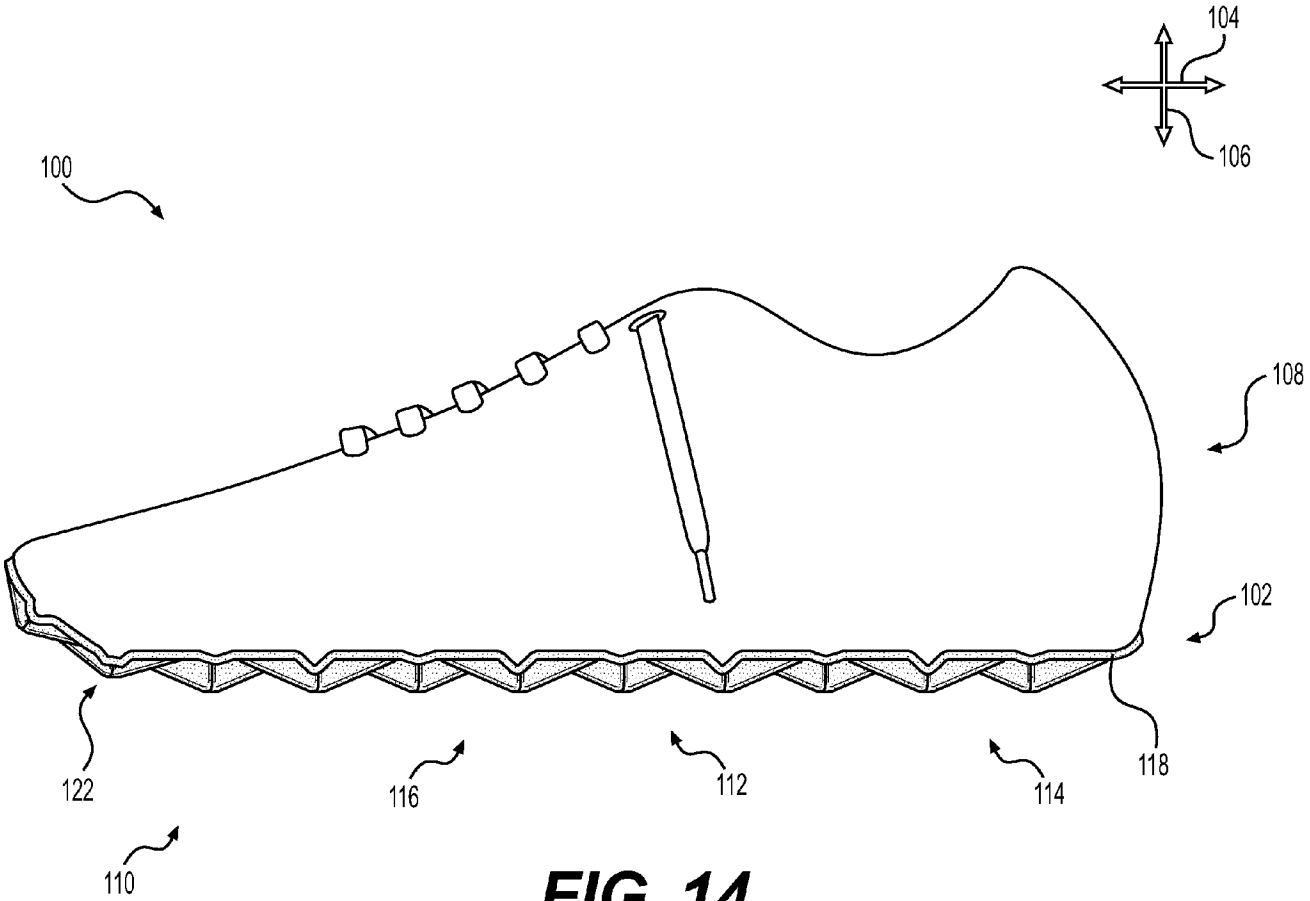
FIG. 14 is a side view of an embodiment of an article of footwear with an outer member.
Figure 15:
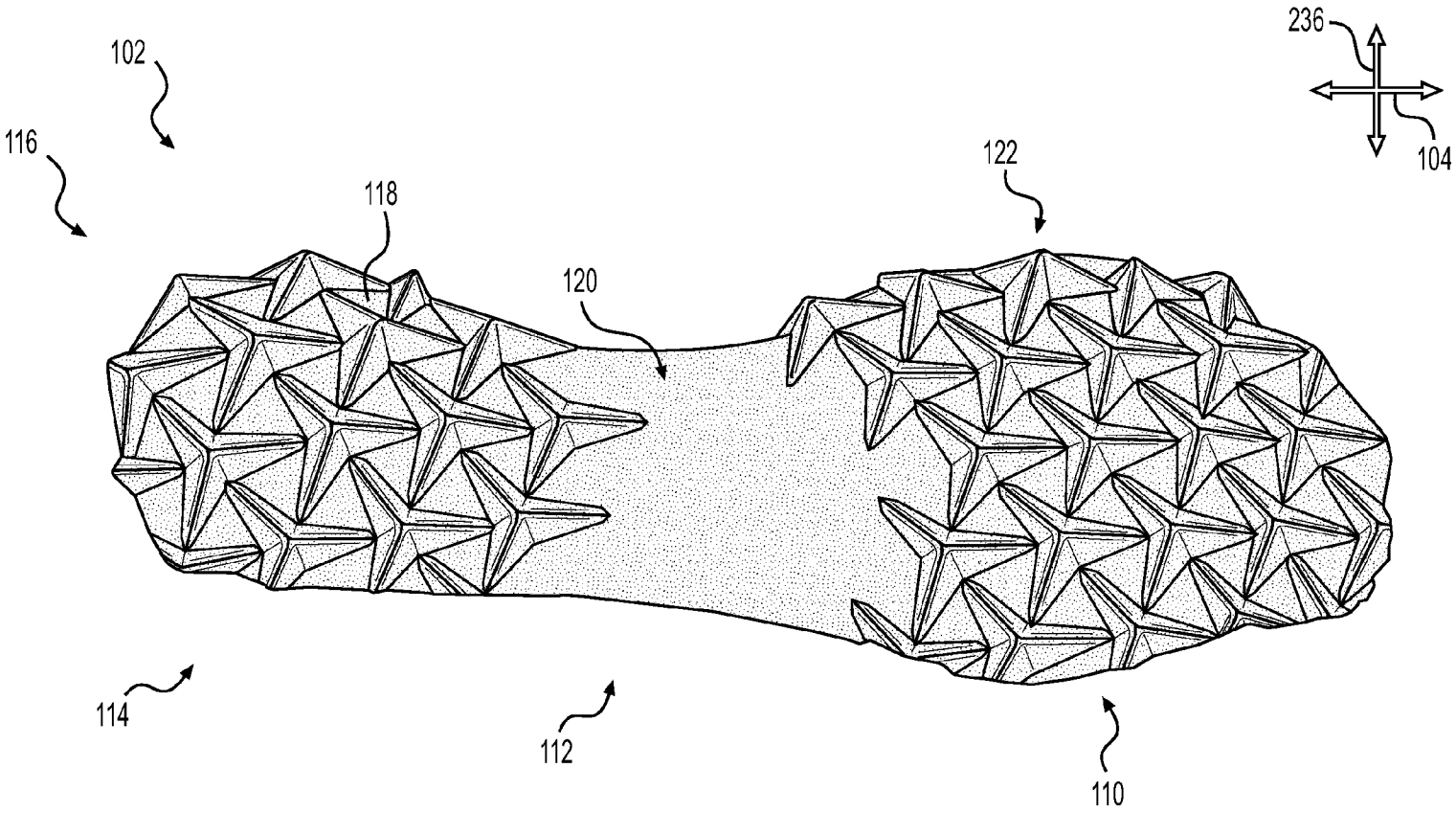
FIG. 15 is a schematic illustration of the outer surface of an embodiment of an outer member with ground engaging members for an article of footwear.
Figure 16:
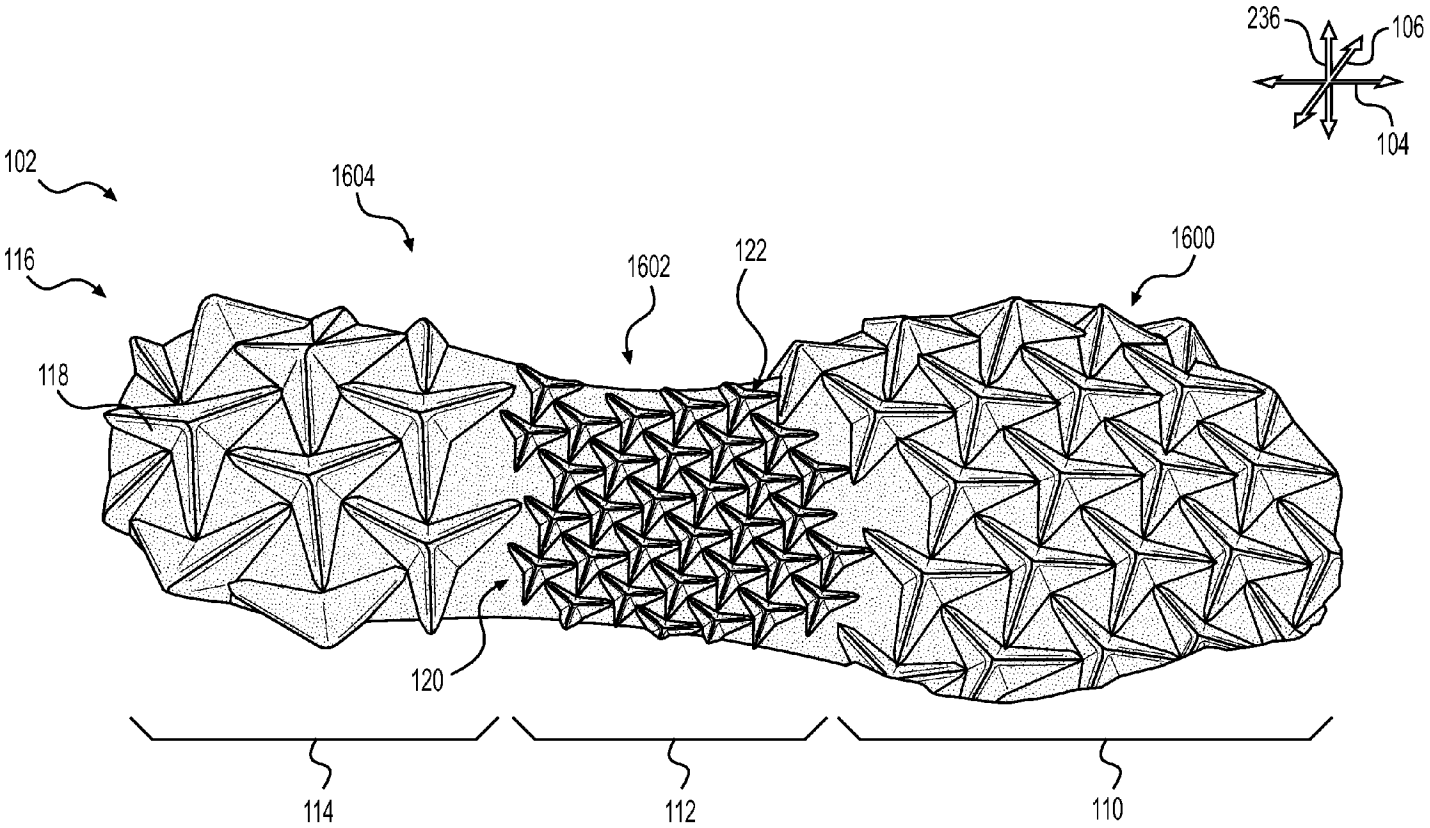
FIG. 16 is a schematic illustration of the outer surface of an embodiment of an outer member with ground engaging members for an article of footwear.

FIGS. 14-16 depict different embodiments of article of footwear 100 with ground engaging members 122. FIG. 14 depicts a side-view of one embodiment of assembled article of footwear 100, including sole structure 102 and upper 108. In some embodiments, ground engaging members 122 may vary in height from one another. In another embodiment, as shown in FIG. 14, ground engaging members 122 may have substantially similar heights throughout outer member 116.

In some embodiments, ground engaging members 122 may be disposed all along outer member 116, so that substantially the entire base portion 120 of outer member 116 from forefoot region 110 to heel region 114 includes ground engaging members 122. In other embodiments, ground engaging members 122 may be utilized at any suitable location of outer member 116. In some embodiments, ground engaging members 122 having particular shapes and configurations may be disposed at regions of outer member 116 corresponding with various anatomical portions of the foot. Furthermore, in some embodiments, article 100 may include greater or fewer ground engaging members 122 as desired to provide performance characteristics suitable for the desired use.

For example, as illustrated in FIG. 15, one or more ground engaging members 122 may be disposed in areas that correspond with forefoot region 110 and heel region 114. An athlete may place a significant amount of their weight on these regions during certain movements, such as cutting in a lateral direction 236, or during abrupt stopping. Such an embodiment may provide an athlete with greater flexibility along midfoot region 112. In other embodiments, forefoot region 110 may have a reduced number of ground engaging members 122, in order to provide sole structure with even greater flexibility along forefoot region 110. Such portions may include at least one ground engaging member 122 in order to provide traction in lateral direction 236. However, an article of footwear that includes ground engaging members 122 in forefoot region 110 and/or other regions, as depicted in FIG. 15, may nevertheless continue to provide a high level of flexibility in those regions, due to the construction of outer member 116 described herein.

The configuration of sole structure 102 may vary significantly according to one or more types of ground surfaces on which sole structure 102 may be used in different embodiments. Accordingly, outer member 116 may be configured to provide traction on various surfaces, such as natural turf (e.g., grass), synthetic turf, dirt, snow. In some embodiments, sole structure 102 may also vary based on the properties and conditions of the surfaces on which article 100 is anticipated to be used. For example, sole structure 102 may vary depending on whether the surface is harder or softer. In addition, sole structure 102 may be tailored for use in wet or dry conditions. In other embodiments, the configuration of sole structure 102, including the traction pattern of outer member 116, may vary significantly according to the type of activity for which article 100 is anticipated to be used (for example, running, soccer, baseball, football, and other activities), as described further below.

In some embodiments, sole structure 102 may be configured for versatility. For example, sole structure 102 may be configured to provide traction and stability on a variety of surfaces, having a range of properties, and/or under various conditions. In another embodiment, a versatile embodiment of sole structure 102 may include both larger and medium sized ground engaging members 122, and/or ground engaging members 122 having moderately to minimally aggressive shapes, a different number of hinge portions, and being disposed in different regions of outer member 116. In FIG. 16, for example, a series of large three-pointed diamond shaped ground engaging members 1604 are disposed in heel region 114 and a series of medium three-pointed diamond shaped ground engaging members 1600 are disposed in forefoot region 110. Furthermore, a number of small three-pointed star shaped ground engaging members 1602 are disposed in midfoot region 112. While the number, size, and shape of ground engaging members 122 are provided as examples, other structural parameters may be varied in order to tailor article 100 for traction and stability on various surfaces, and/or in a variety of conditions. Additional such parameters may include, for example, the use of secondary traction elements, placement of ground engaging members 122, the relative softness or hardness of the ground engaging members 122 and/or sole structure 102 in general, the relative flexibility of portions of sole structure 102, and other such parameters.

In different embodiments, there may be outer member areas 272 that move relative to ground engaging members 122 in order to allow expansion and/or compression. For example, in FIGS. 17 and 18, a first outer member area 1700, a second outer member area 1702, a third outer member area 1704, a fourth outer member area 1706, a fifth outer member area 1708, and a sixth outer member area 1710 are shown in the context of a sole structure 1754. Outer member areas 272 surrounding a first ground engaging member 1748 in FIGS. 17 and 18 have a substantially triangular shape.

Figures 17, 18:
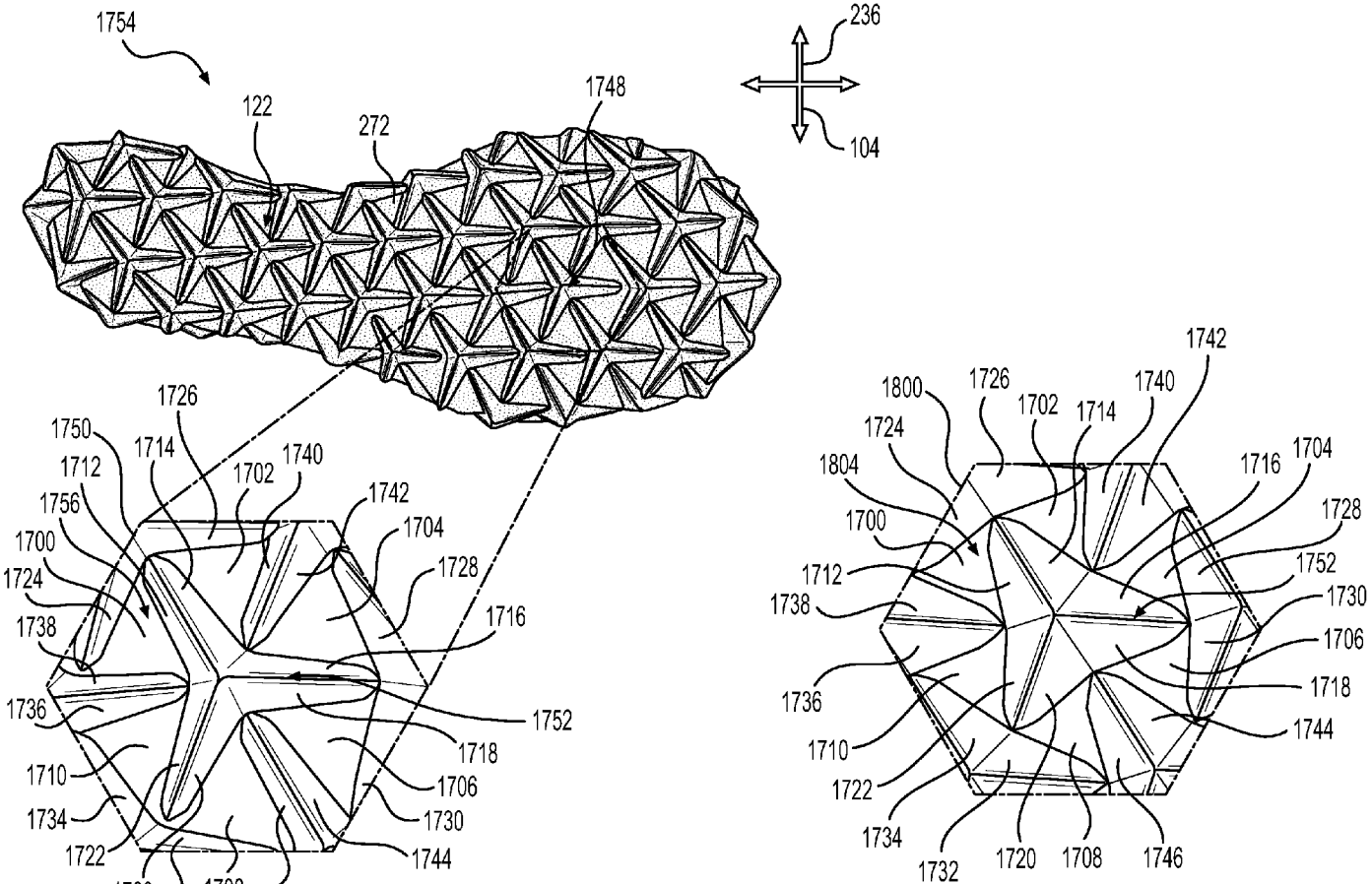
FIG. 17 is an illustration of the outer surface of an embodiment of an outer member for an article of footwear.
FIG. 18 is an illustration of a region of an embodiment of an outer member for an article of footwear.

Each outer member area depicted in a magnified area 1750 and a magnified area 1800 is defined or bounded in part by arm portions and/or faces of adjacent ground engaging members 122. In the embodiment of FIGS. 17 and 18, first outer member area 1700 is bounded by a first face 1712, a seventh face 1724, and a fourteenth face 1738. Second outer member area 1702 is bounded by a second face 1714, an eighth face 1726, and a fifteenth face 1740. Third outer member area 1704 is bounded by a third face 1716, a ninth face 1728, and a sixteenth face 1742. Fourth outer member area 1706 is bounded by a fourth face 1718, a tenth face 1730, and a seventeenth face 1744. Fifth outer member area 1708 is bounded by a fifth face 1720, an eleventh face 1732, and an eighteenth face 1746. Sixth outer member area 1710 is bounded by a sixth face 1722, a twelfth face 1734, and a thirteenth face 1736.

In different embodiments, as one or more ground engaging members 122 of sole structure 1754 expand from FIG. 17 to FIG. 18, outer member areas 272 may shift position and/or orientation. For example, in FIG. 17, first outer member area 1700 has a first position 1756 relative to first ground engaging member 1748. However, after expansion of first ground engaging member 1748 in FIG. 18, first outer member area 1700 has a second position 1804. In some embodiments, first position 1756 of first outer member area 1700 is different from second position 1804. In one embodiment, upon expansion of first ground engaging member 1748, first outer member area 1700 can rotate so that second position 1804 accommodates the expansion of ground engaging members 122. Similarly, in other embodiments, second outer member area 1702, third outer member area 1704, fourth outer member area 1706, fifth outer member area 1708, sixth outer member area 1710, and other outer member areas 272 may also change position relative to adjacent ground engaging members 122 upon the expansion of one or more portions of sole structure 1754. In at least some embodiments, these outer member areas may be seen to rotate with respect to one another, to allow for increases in the horizontal area of the ground engaging members.

Figure 19:
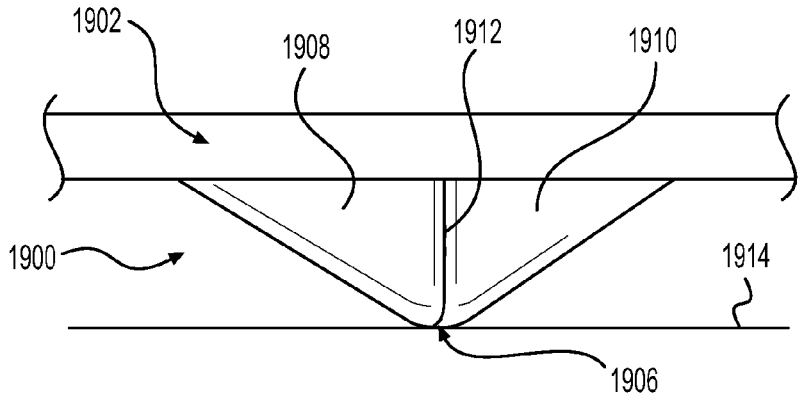
FIG. 19 is a side view of an embodiment of a ground engaging member.
Figure 20:
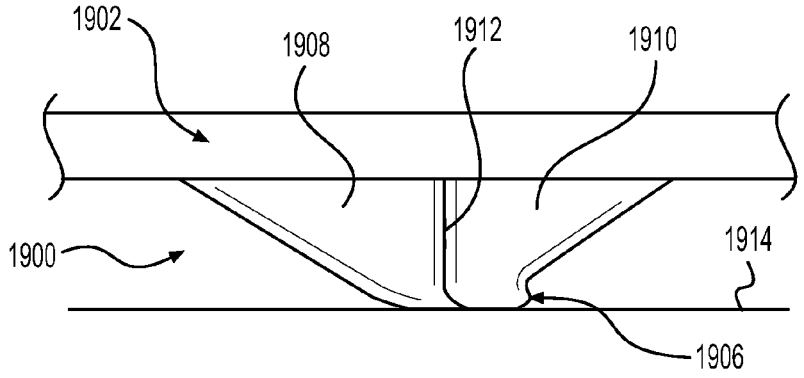
FIG. 20 is a side view of an embodiment of a ground engaging member.
Figure 21:
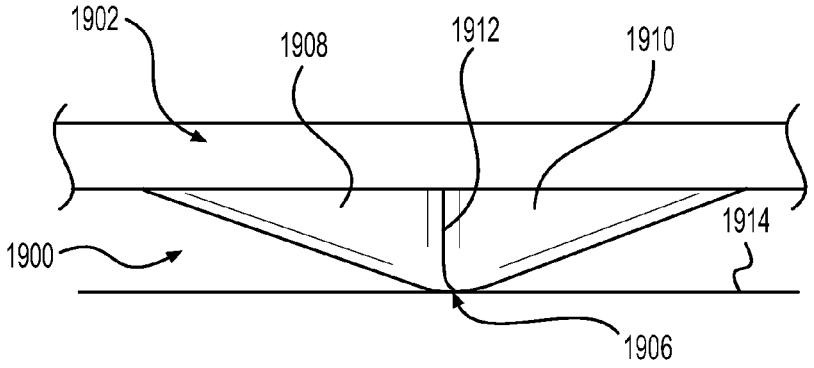
FIG. 21 is a side view of an embodiment of a ground engaging member.

As shown in FIGS. 19-21, in some embodiments, ground engaging members 122 may include additional features that contribute to an increased flexibility and/or responsiveness of outer member 116. In FIG. 19, a ground engaging member 1900 is disposed along a portion of an outer member 1902. Ground engaging member 1900 includes a first face 1908 and a second face 1910. First face 1908 and second face 1910 are joined along a hinge portion 1912. First face 1908, second face 1910, and hinge portion 1912 can be representative of additional faces and/or hinge portions comprising ground engaging member 1900. Furthermore, ground engaging member 1900 includes an apex 1906.

In one embodiment, as shown in FIG. 19, ground engaging member 1900 is lightly contacting a ground surface 1904. Upon the application of greater pressure, as seen in FIGS. 20-21, ground engaging member 1900 can be compressed. Due to the varied properties of the embodiment as described above, ground engaging member 1900 may respond to a force by bending and/or by exhibiting auxetic action. In one embodiment, as shown in FIG. 20, when undergoing bending stresses, apex 1906 of ground engaging member 1900 can respond by bending or flexing to various degrees, deforming at least part of ground engaging member 1900. This bending or deformation may be facilitated by the substantially thicker apex 1906, relative to the faces of ground engaging member 1900, as discussed above and shown in FIG. 9. Such bending and/or deformation may enhance the capacity of ground engaging member 1900 to provide traction. In this embodiment, first face 1908 and second face 1910 do not necessarily rotate along hinge portion 1912, and there may be little or no auxetic action. In another embodiment, as shown in FIG. 21, ground engaging member 1900 can respond to forces by expanding in an auxetic action. Thus, the auxetic structure of ground engaging member 1900, as represented by the movement of first face 1908 relative to second face 1920 along hinge portion 1912, may permit ground engaging member 1900 to respond to the force through an expansion of ground engaging member 1900 and corresponding portions of outer member 1902. It should be noted that in other embodiments, in response to a force, ground engaging member 1900 may exhibit various deformations, for example though bending as well as expansion resulting from an auxetic action.

In some cases, it may be advantageous to provide increased torsional traction on one foot, and to provide decreased torsional traction on the other foot to enable greater freedom of motion. That is, it may be desirable to provide one or more portions of the rear foot with a reduced amount of torsional traction and provide one or more portions of the front foot with an increased amount of torsional traction. Accordingly, in some embodiments, asymmetric outer members may be provided for left and right feet. That is, outer member 116 for a left foot may be a non-mirror image of the outer member 116 for a right foot.

While various embodiments of the embodiment have been described, the description is intended to be exemplary, rather than limiting and it will be apparent to those of ordinary skill in the art that many more embodiments and implementations are possible that are within the scope of the embodiment. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the embodiment is not to be restricted except in light of the attached claims and their equivalents. Also, various modifications and changes may be made within the scope of the attached claims.

What is claimed is:

1. A sole structure for an article of footwear, the sole structure comprising:

an outer member comprising a base portion and a plurality of ground engaging members extending away from the base portion, wherein each of the ground engaging members is hollow and defines a three-pointed star shaped aperture at an upper surface of the base portion, and wherein the base portion defines a plurality of triangular-shaped outer member areas, each triangular-shaped outer member area being disposed between adjacent ground engaging members;

wherein each of the plurality of ground engaging members comprises six faces joined at a common apex point located outward from the base portion on an outer side of the outer member;

wherein the arrangement of the plurality of ground engaging members across the outer member provides the outer member with an auxetic property such that when a tensile force is applied to the outer member in a first direction, the outer member expands in both the first direction and in a second direction that is orthogonal to the first direction.

2. The sole structure according to claim 1, wherein the six faces include a first face, a second face, a third face, a fourth face, a fifth face and a sixth face and wherein each face has an approximately triangular shape; and wherein the first face is joined to the second face along a first hinge portion, wherein the second face is joined to the third face along a second hinge portion, wherein the third face is joined to the fourth face along a third hinge portion, wherein the fourth face is joined to the fifth face along a fourth hinge portion, wherein the fifth face is joined to the sixth face along a fifth hinge portion and wherein the sixth face is joined to the first face along a sixth hinge portion;

wherein the first, third, and fifth hinge portions each intersect with a vertex of a respective three-pointed star shaped aperture, and wherein each of the second, fourth, and sixth hinge portions rotate radially outward when the tensile force is applied to the outer member.

3. A sole structure for an article of footwear, the sole structure comprising:

an outer member comprising a base portion and a plurality of ground engaging members extending away from the base portion, wherein each of the ground engaging members is hollow and defines a three-pointed star shaped aperture extending through the base portion, and wherein the base portion defines a plurality of triangular-shaped outer member areas, each triangular-shaped outer member area disposed between adjacent ground engaging members;

each of the ground engaging members comprising a plurality of faces extending from the base portion, wherein each of the plurality of faces are joined at an apex of the respective ground engaging member;

each of the ground engaging members having a substantially three-pointed cross-sectional shape in a horizontal plane;

each of the ground engaging members including three arms, each of the three arms including two faces of the plurality of faces wherein for each of the ground engaging members:

the three arms comprising a first arm, a second arm, and a third arm, each of the three arms radiating outward from a central region of the respective ground engaging member, the central region having a substantially triangular shape in the horizontal plane;

the first arm portion comprising a substantially elongated shape extending outward from the central region;

each of the arm portions being substantially similar in shape and size;

the first arm portion having a first width and a second width, the first width being nearer to the central region than the second width, the first width being larger than the second width; and wherein the ground engaging member includes a hollow interior portion bounded by the plurality of faces to permit the plurality of faces to rotate relative to each other in response to an applied force, and wherein the arrangement of the plurality of ground engaging members across the base portion provides an auxetic property to the outer member such that when a tensile force is applied to the outer member in a first direction, the outer member expands in both the first direction and in a second direction that is orthogonal to the first direction.

4. The sole structure according to claim 3, wherein the first arm portion and the second arm portion form a first angle, and wherein the first angle increases in magnitude when a compressive force is applied to the ground engaging member.

5. The sole structure according to claim 3, wherein the apex is thicker than the base portion.

6. The sole structure according to claim 3, wherein each face of the plurality of faces is substantially flat.

7. The sole structure according to claim 3, wherein each face of the plurality of faces has an approximately triangular geometry.

8. The sole structure according to claim 4, wherein the second arm portion and the third arm portion form a second angle, and wherein the first angle is substantially similar to the second angle.

* * * * *